US009484619B2

(12) United States Patent
Korva et al.

(10) Patent No.: US 9,484,619 B2
(45) Date of Patent: Nov. 1, 2016

(54) SWITCHABLE DIVERSITY ANTENNA APPARATUS AND METHODS

(75) Inventors: Heikki Korva, Tupos (FI); Ari Raappana, Kello (FI); Petteri Annamaa, Oulunsalo (FI)

(73) Assignee: PULSE FINLAND OY (FI)

( * ) Notice: Subject to any disclaimer, the term of this patent is extended or adjusted under 35 U.S.C. 154(b) by 1125 days.

(21) Appl. No.: 13/333,588

(22) Filed: Dec. 21, 2011

(65) Prior Publication Data

US 2013/0162486 A1 Jun. 27, 2013

(51) Int. Cl.

| | |
|---|---|
| ***H01Q 1/38*** | (2006.01) |
| ***H01Q 1/24*** | (2006.01) |
| ***H01Q 21/24*** | (2006.01) |
| ***H01Q 21/30*** | (2006.01) |
| ***H01Q 5/378*** | (2015.01) |

(52) U.S. Cl.

CPC ..... *H01Q 1/243* (2013.01); *H01Q 5/378* (2015.01); *H01Q 21/24* (2013.01); *H01Q 21/30* (2013.01)

(58) Field of Classification Search

CPC ..... H01Q 1/243; H01Q 1/38; H01Q 9/0421
USPC ..... 343/700 MS, 702, 876, 725
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |

(Continued)

FOREIGN PATENT DOCUMENTS

| | | | |
|---|---|---|---|
| CN | 1387688 | A | 12/2002 |
| CN | 1954460 | A | 4/2007 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Dameon E Levi
*Assistant Examiner* — Collin Dawkins
(74) *Attorney, Agent, or Firm* — Gazdzinski & Associates, PC

(57) ABSTRACT

An active diversity antenna apparatus and methods of tuning and utilizing the same. In one embodiment, the active diversity antenna is used within a handheld mobile device (e.g., cellular telephone or smartphone), and enables device operation in several low frequency bands (LBs). The exemplary implementation of the active LB diversity antenna comprises a directly fed radiator portion and a grounded (coupled fed) radiator portion. The directly fed portion is fed via a feed element connected to an antenna feed. The coupled fed portion of the LB antenna is grounded, forming a resonating part of the low frequency band. A gap between the two antenna portions is used to adjust antenna Q-value. Resonant frequency tuning is achieved by changing the length of the grounded element. The LB feed element is disposed proximate the feed element of a high band diversity antenna, thus reducing transmission losses and improving diplexer operation.

21 Claims, 15 Drawing Sheets

(56) References Cited

U.S. PATENT DOCUMENTS

| | | | |
|---|---|---|---|
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |
| 4,652,889 | A | 3/1987 | Bizouard et al. |
| 4,661,992 | A | 4/1987 | Garay et al. |
| 4,692,726 | A | 9/1987 | Green et al. |
| 4,703,291 | A | 10/1987 | Nishikawa et al. |
| 4,706,050 | A | 11/1987 | Andrews |
| 4,716,391 | A | 12/1987 | Moutrie et al. |
| 4,740,765 | A | 4/1988 | Ishikawa et al. |
| 4,742,562 | A | 5/1988 | Kommrusch |
| 4,761,624 | A | 8/1988 | Igarashi et al. |
| 4,800,348 | A | 1/1989 | Rosar et al. |
| 4,800,392 | A | 1/1989 | Garay et al. |
| 4,821,006 | A | 4/1989 | Ishikawa et al. |
| 4,823,098 | A | 4/1989 | DeMuro et al. |
| 4,827,266 | A | 5/1989 | Sato et al. |
| 4,829,274 | A | 5/1989 | Green et al. |
| 4,835,538 | A | 5/1989 | McKenna et al. |
| 4,835,541 | A | 5/1989 | Johnson et al. |
| 4,862,181 | A | 8/1989 | PonceDeLeon et al. |
| 4,879,533 | A | 11/1989 | De Muro et al. |
| 4,896,124 | A | 1/1990 | Schwent |
| 4,907,006 | A | 3/1990 | Nishikawa et al. |
| 4,954,796 | A | 9/1990 | Green et al. |
| 4,965,537 | A | 10/1990 | Kommrusch |
| 4,977,383 | A | 12/1990 | Niiranen |
| 4,980,694 | A | 12/1990 | Hines |
| 5,016,020 | A | 5/1991 | Simpson |
| 5,017,932 | A | 5/1991 | Ushiyama et al. |
| 5,043,738 | A | 8/1991 | Shapiro et al. |
| 5,047,739 | A | 9/1991 | Kuokkanene |
| 5,053,786 | A | 10/1991 | Silverman et al. |
| 5,057,847 | A | 10/1991 | Vaisanen |
| 5,061,939 | A | 10/1991 | Nakase |
| 5,097,236 | A | 3/1992 | Wakino et al. |
| 5,103,197 | A | 4/1992 | Turunen |
| 5,109,536 | A | 4/1992 | Kommrusch |
| 5,155,493 | A | 10/1992 | Thursby et al. |
| 5,157,363 | A | 10/1992 | Puurunen |
| 5,159,303 | A | 10/1992 | Flink |
| 5,166,697 | A | 11/1992 | Viladevall et al. |
| 5,170,173 | A | 12/1992 | Krenz et al. |
| 5,203,021 | A | 4/1993 | Repplinger et al. |
| 5,210,510 | A | 5/1993 | Karsikas |
| 5,210,542 | A | 5/1993 | Pett et al. |
| 5,220,335 | A | 6/1993 | Huang |
| 5,229,777 | A | 7/1993 | Doyle |
| 5,239,279 | A | 8/1993 | Turunen |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen |
| 5,304,968 | A | 4/1994 | Ohtonen |
| 5,307,036 | A | 4/1994 | Turunen |
| 5,319,328 | A | 6/1994 | Turunen |
| 5,349,315 | A | 9/1994 | Ala-Kojola |
| 5,349,700 | A | 9/1994 | Parker |
| 5,351,023 | A | 9/1994 | Niiranen |
| 5,354,463 | A | 10/1994 | Turunen |
| 5,355,142 | A | 10/1994 | Marshall et al. |
| 5,357,262 | A | 10/1994 | Blaese |
| 5,363,114 | A | 11/1994 | Shoemaker |
| 5,369,782 | A | 11/1994 | Kawano et al. |
| 5,382,959 | A | 1/1995 | Pett et al. |
| 5,386,214 | A | 1/1995 | Sugawara |
| 5,387,886 | A | 2/1995 | Takalo |
| 5,394,162 | A | 2/1995 | Korovesis et al. |
| RE34,898 | E | 4/1995 | Turunen |
| 5,408,206 | A | 4/1995 | Turunen |
| 5,418,508 | A | 5/1995 | Puurunen |
| 5,432,489 | A | 7/1995 | Yrjola |
| 5,438,697 | A | 8/1995 | Fowler et al. |
| 5,440,315 | A | 8/1995 | Wright et al. |
| 5,442,366 | A | 8/1995 | Sanford |
| 5,444,453 | A | 8/1995 | Lalezari |
| 5,467,065 | A | 11/1995 | Turunen |
| 5,473,295 | A | 12/1995 | Turunen |
| 5,506,554 | A | 4/1996 | Ala-Kojola |
| 5,508,668 | A | 4/1996 | Prokkola |
| 5,510,802 | A | 4/1996 | Tsuru et al. |
| 5,517,683 | A | 5/1996 | Collett et al. |
| 5,521,561 | A | 5/1996 | Yrjola |
| 5,526,003 | A | 6/1996 | Ogawa et al. |
| 5,532,703 | A | 7/1996 | Stephens et al. |
| 5,541,560 | A | 7/1996 | Turunen |
| 5,541,617 | A | 7/1996 | Connolly et al. |
| 5,543,764 | A | 8/1996 | Turunen |
| 5,550,519 | A | 8/1996 | Korpela |
| 5,557,287 | A | 9/1996 | Pottala et al. |
| 5,557,292 | A | 9/1996 | Nygren et al. |
| 5,566,441 | A | 10/1996 | Marsh et al. |
| 5,570,071 | A | 10/1996 | Ervasti |
| 5,585,771 | A | 12/1996 | Ervasti |
| 5,585,810 | A | 12/1996 | Tsuru et al. |
| 5,589,844 | A | 12/1996 | Belcher et al. |
| 5,594,395 | A | 1/1997 | Niiranen |
| 5,604,471 | A | 2/1997 | Rattila |
| 5,627,502 | A | 5/1997 | Ervasti |
| 5,649,316 | A | 7/1997 | Prudhomme et al. |
| 5,668,561 | A | 9/1997 | Perrotta et al. |
| 5,675,301 | A | 10/1997 | Nappa |
| 5,689,221 | A | 11/1997 | Niiranen |
| 5,694,135 | A | 12/1997 | Dikun et al. |
| 5,696,517 | A | 12/1997 | Kawahata et al. |
| 5,703,600 | A | 12/1997 | Burrell et al. |
| 5,709,832 | A | 1/1998 | Hayes et al. |
| 5,711,014 | A | 1/1998 | Crowley et al. |
| 5,717,368 | A | 2/1998 | Niiranen |
| 5,731,749 | A | 3/1998 | Yrjola |
| 5,734,305 | A | 3/1998 | Ervasti |
| 5,734,350 | A | 3/1998 | Deming et al. |
| 5,734,351 | A | 3/1998 | Ojantakanen |
| 5,739,735 | A | 4/1998 | Pyykko |
| 5,742,259 | A | 4/1998 | Annamaa |
| 5,757,327 | A | 5/1998 | Yajima et al. |
| 5,760,746 | A | 6/1998 | Kawahata |
| 5,764,190 | A | 6/1998 | Murch et al. |
| 5,767,809 | A | 6/1998 | Chuang et al. |
| 5,768,217 | A | 6/1998 | Sonoda et al. |
| 5,777,581 | A | 7/1998 | Lilly et al. |
| 5,777,585 | A | 7/1998 | Tsuda et al. |
| 5,793,269 | A | 8/1998 | Ervasti |
| 5,797,084 | A | 8/1998 | Tsuru et al. |
| 5,812,094 | A | 9/1998 | Maldonado |
| 5,815,048 | A | 9/1998 | Ala-Kojola |
| 5,822,705 | A | 10/1998 | Lehtola |
| 5,852,421 | A | 12/1998 | Maldonado |
| 5,861,854 | A | 1/1999 | Kawahata et al. |
| 5,874,926 | A | 2/1999 | Tsuru et al. |
| 5,880,697 | A | 3/1999 | McCarrick et al. |
| 5,886,668 | A | 3/1999 | Pedersen et al. |
| 5,892,490 | A | 4/1999 | Asakura et al. |
| 5,903,820 | A | 5/1999 | Hagstrom |
| 5,905,475 | A | 5/1999 | Annamaa |
| 5,920,290 | A | 7/1999 | McDonough et al. |
| 5,926,139 | A | 7/1999 | Korisch |
| 5,929,813 | A | 7/1999 | Eggleston |
| 5,936,583 | A | 8/1999 | Sekine et al. |
| 5,943,016 | A | 8/1999 | Snyder, Jr. et al. |
| 5,952,975 | A | 9/1999 | Pedersen et al. |
| 5,959,583 | A | 9/1999 | Funk |
| 5,963,180 | A | 10/1999 | Leisten |

(56) References Cited

U.S. PATENT DOCUMENTS 5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,106 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor

(56) References Cited

U.S. PATENT DOCUMENTS 6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavlejevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Perunka et al.
7,616,158 B2 11/2009 Mak et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson
7,889,143 B2 2/2011 Milosavljevic
7,901,617 B2 3/2011 Taylor et al.
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0192723 A1 8/2006 Harada
2006/0214857 A1 9/2006 Ollikainen
2007/0042615 A1 2/2007 Liao
2007/0082789 A1 4/2007 Nissila
2007/0152881 A1 7/2007 Chan
2007/0188388 A1 8/2007 Feng
2007/0268190 A1* 11/2007 Huynh ..... H01Q 1/243 343/702
2008/0055164 A1 3/2008 Zhang et al.
2008/0059106 A1 3/2008 Wight
2008/0088511 A1 4/2008 Sorvala
2008/0231526 A1* 9/2008 Sato ..... 343/722
2008/0266199 A1 10/2008 Milosavljevic
2008/0284661 A1* 11/2008 He ..... H01Q 9/0421 343/700 MS
2008/0303729 A1* 12/2008 Milosavljevic ..... H01Q 1/243 343/722
2008/0305750 A1* 12/2008 Alon ..... H01Q 9/0485 455/77
2009/0009415 A1 1/2009 Tanska
2009/0135066 A1 5/2009 Raappana et al.
2009/0140942 A1* 6/2009 Mikkola ..... H01Q 1/243 343/767
2009/0153412 A1 6/2009 Chiang et al.
2009/0174604 A1 7/2009 Keskitalo
2009/0196160 A1 8/2009 Crombach
2009/0197654 A1 8/2009 Teshima
2009/0231213 A1 9/2009 Ishimiya
2010/0053002 A1* 3/2010 Wojack ..... H01Q 9/42 343/702
2010/0079346 A1* 4/2010 Olson ..... H01Q 1/12 343/702
2010/0103069 A1* 4/2010 Wang et al. ..... 343/846
2010/0220016 A1 9/2010 Nissinen
2010/0244978 A1 9/2010 Milosavljevic

(56) References Cited

U.S. PATENT DOCUMENTS

| | | | | |
|---|---|---|---|---|
| 2010/0245194 | A1* | 9/2010 | Sawazaki et al. | 343/743 |
| 2010/0302123 | A1* | 12/2010 | Knudsen | H01Q 5/35 343/861 |
| 2010/0309092 | A1 | 12/2010 | Lambacka | |
| 2011/0133994 | A1 | 6/2011 | Korva | |
| 2012/0119955 | A1 | 5/2012 | Milosavljevic et al. | |

FOREIGN PATENT DOCUMENTS

| | | | |
|---|---|---|---|
| CN | 1316797 | | 10/2007 |
| CN | 101356689 | A | 1/2009 |
| DE | 10104862 | | 8/2002 |
| DE | 10150149 | | 4/2003 |
| EP | 0 208 424 | | 1/1987 |
| EP | 0 376 643 | | 4/1990 |
| EP | 0 751 043 | | 4/1997 |
| EP | 0 807 988 | | 11/1997 |
| EP | 0 831 547 | | 3/1998 |
| EP | 0 851 530 | | 7/1998 |
| EP | 1 294 048 | | 1/1999 |
| EP | 1 014 487 | | 6/2000 |
| EP | 1 024 553 | | 8/2000 |
| EP | 1 067 627 | | 1/2001 |
| EP | 0 923 158 | | 9/2002 |
| EP | 1 329 980 | | 7/2003 |
| EP | 1 361 623 | | 11/2003 |
| EP | 1 406 345 | | 4/2004 |
| EP | 1 453 137 | | 9/2004 |
| EP | 1 220 456 | | 10/2004 |
| EP | 1 467 456 | | 10/2004 |
| EP | 1 753 079 | | 2/2007 |
| FI | 20020829 | | 11/2003 |
| FI | 118782 | | 3/2008 |
| FR | 2553584 | | 10/1983 |
| FR | 2724274 | | 3/1996 |
| FR | 2873247 | | 1/2006 |
| GB | 2266997 | | 11/1993 |
| GB | 2360422 | | 9/2001 |
| GB | 2389246 | | 12/2003 |
| JP | 59-202831 | | 11/1984 |
| JP | 60-206304 | | 10/1985 |
| JP | 61-245704 | | 11/1986 |
| JP | 06-152463 | | 5/1994 |
| JP | 07-131234 | | 5/1995 |
| JP | 07-221536 | | 8/1995 |
| JP | 07-249923 | | 9/1995 |
| JP | 07-307612 | | 11/1995 |
| JP | 08-216571 | | 8/1996 |
| JP | 09-083242 | | 3/1997 |
| JP | 09-260934 | | 10/1997 |
| JP | 09-307344 | | 11/1997 |
| JP | 10-028013 | | 1/1998 |
| JP | 10-107671 | | 4/1998 |
| JP | 10-173423 | | 6/1998 |
| JP | 10-209733 | | 8/1998 |
| JP | 10-224142 | | 8/1998 |
| JP | 10-322124 | | 12/1998 |
| JP | 10-327011 | | 12/1998 |
| JP | 11-004113 | | 1/1999 |
| JP | 11-004117 | | 1/1999 |
| JP | 11-068456 | | 3/1999 |
| JP | 11-127010 | | 5/1999 |
| JP | 11-127014 | | 5/1999 |
| JP | 11-136025 | | 5/1999 |
| JP | 11-355033 | | 12/1999 |
| JP | 2000-278028 | | 10/2000 |
| JP | 2001-053543 | | 2/2001 |
| JP | 2001-267833 | | 9/2001 |
| JP | 2001-217631 | | 10/2001 |
| JP | 2001-326513 | | 11/2001 |
| JP | 2002-319811 | | 10/2002 |
| JP | 2002-329541 | | 11/2002 |
| JP | 2002-335117 | | 11/2002 |
| JP | 2003-060417 | | 2/2003 |
| JP | 2003-124730 | | 4/2003 |
| JP | 2003-179426 | | 6/2003 |
| JP | 2004-112028 | | 4/2004 |
| JP | 2004-363859 | | 12/2004 |
| JP | 2005-005985 | | 1/2005 |
| JP | 2005-252661 | | 9/2005 |
| KR | 20010080521 | | 10/2001 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 99/30479 | | 6/1999 |
| WO | WO 01/20718 | | 3/2001 |
| WO | WO 01/29927 | | 4/2001 |
| WO | WO 01/33665 | | 5/2001 |
| WO | WO 01/61781 | | 8/2001 |
| WO | WO 2004/017462 | | 2/2004 |
| WO | WO 2004/057697 | | 7/2004 |
| WO | WO 2004/100313 | | 11/2004 |
| WO | WO 2004/112189 | | 12/2004 |
| WO | WO 2005/062416 | | 7/2005 |
| WO | WO 2007/012697 | | 2/2007 |
| WO | WO 2010/122220 | | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13,56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

(56) References Cited

OTHER PUBLICATIONS

Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", Electronic Letters, vol. 40, No. 15, pp. 920-921, Jul. 2004
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, loannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in 2000 *IEEE Antennas Propagat. Soc. Int, Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. 2003, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

* cited by examiner

SWITCHABLE DIVERSITY ANTENNA APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to antenna apparatus for use in electronic devices such as wireless or portable radio devices, and more particularly in one exemplary aspect to a switchable diversity antenna operable in a lower frequency range, and methods of tuning and utilizing the same.

DESCRIPTION OF RELATED TECHNOLOGY

Internal antennas are an element found in most modern radio devices, such as mobile computers, mobile phones, Blackberry® devices, smartphones, personal digital assistants (PDAs), or other personal communication devices (PCDs). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used.

Radio devices operating indoor or in urban environment often experience performance degradation due to multipath interference or loss, especially when there is no clear line-of-sight (LOS) between a transmitter and a receiver. Instead, the signal is reflected along multiple paths before finally being received. Each of these "bounces" can introduce phase shifts, time delays, attenuations, and distortions that can destructively interfere with one another at the aperture of the receiving antenna.

Antenna diversity, one of several wireless diversity schemes that use two or more antennas to improve the quality and reliability of a wireless link, is especially effective at mitigating these multipath situations. This is because multiple receive antennas offer a receiver several observations of the same signal; each antenna signal experiences a different interference environment during propagation through the wireless channel. Collectively, multiple antenna system can provide a more robust link, compared to a single antenna solution.

The use of multiple diversity antennas invariably requires additional hardware (e.g., antenna radiator, connective cabling, and, optionally, matching circuitry), and may increase size of a portable radio communications device, which is often not desirable.

Various methods are presently employed to provide antenna diversity. High frequency range or band (HB) diversity antenna solutions are more readily obtained (due to primarily a smaller radiator required to operate at higher frequencies) without resulting in an increased device size.

One typical prior art low frequency band (LB) diversity antenna solution is presented in FIG. 1. The mobile device 100 comprises one or more main antennas (104, 106) and a low band passive diversity antenna 108. The area denoted by the line 114 in FIG. 1 depicts space reserved for a high band diversity antenna. The LB diversity antenna 108 comprises passive antenna structure, and is coupled to the mobile device feed port 112 via a shunt inductor matching to ground. The LB diversity antenna 108 configuration and placement (as shown in FIG. 1) provide the lowest envelope correlation in low frequency range, for example, 700-960 MHz. When using an additional parasitic element 110 (grounded at the point 122), the LB diversity antenna 108 is capable of covering two distinct operational bands in the low frequency range, for example Band VIII and Band XII of a Long Term Evolution (LTE) standard. However, presently available passive lower band diversity antenna solutions (i) cover a limited number of operating bands (single band without parasitic radiator element, or two bands with one parasitic radiator), (ii) are characterized by poor radiation efficiency of the parasitic radiator, and (iii) require long coaxial feed cables in order to combine low band and high band diversity antenna feeds. These long cables create antenna diplexer impedance mismatch which, in turn, causes additional electric resonances, and shifts the frequency of the antenna response as the electrical length of the feed connector varies.

In addition, monopole antennas, presently used for low band diversity, are susceptible to dielectric loading due to handling by users during host device operation.

Accordingly, there is a salient need for a spatial diversity antenna solution for e.g., a portable radio device with a small form factor, and which offers a lower complexity and improved robustness, as well as providing for improved control of antenna resonance during operation.

SUMMARY OF THE INVENTION

The present invention satisfies the foregoing needs by providing, inter alia, a space-efficient diversity antenna apparatus, and methods of tuning and use thereof.

In a first aspect of the invention, diversity antenna apparatus is disclosed. In one embodiment, the apparatus is active and includes: a first antenna apparatus configured to operate in a first frequency range and comprising a first feed portion configured to be coupled to a feed structure of a radio device; and a second antenna apparatus configured to operate in a second frequency range, and comprising: a first radiator comprising a second feed portion configured to couple a radiating portion to the feed structure; a second radiator comprising a first portion and a second portion, the second portion configured to be coupled to a ground plane of the radio device; and selector apparatus configured to selectively couple the first portion to the ground plane. In one variant, the selector is configured to enable wireless communication of the radio device in at least two operational bands within the second frequency range.

In another variant, the second frequency range is lower in frequency than the first frequency range, and the first and second frequency ranges do not appreciably overlap in frequency.

In a further variant, the at least two operational bands comprise bands specified by a Long Term Evolution (LTE) wireless communications standard.

In yet another variant, the selector apparatus comprises a switch, such as e.g., a single pole, multi-throw switch.

In another variant, the coupled feed configuration enables the diversity antenna apparatus to be substantially insensitive to dielectric loading during device operation; and In another embodiment, the diversity antenna apparatus comprises a directly fed radiator portion and a grounded (coupled fed) radiator portion. The directly fed portion is fed via a feed element coupled to an antenna feed (e.g., at the center of the ground plane edge). The coupled fed portion of the antenna is grounded, forming a resonating part of the low frequency band. A gap between the two antenna portions is used to adjust antenna Q-value. Resonant frequency tuning is achieved by changing the length of the grounded element. The low band feed element is disposed proximate feed element of a high band diversity antenna, thus reducing transmission losses and improving diplexer operation.

In a second aspect of the invention, a mobile communications device is disclosed. In one embodiment, the device comprises a cellular telephone or smartphone which includes the active diversity antenna apparatus discussed supra.

In another embodiment, the mobile device includes: an enclosure comprising a plurality of sides; an electronics assembly comprising a ground plane and at least one feed structure; a main antenna assembly configured to operate in a lower frequency range and an upper frequency range and disposed proximate a bottom side of the plurality of sides; and a diversity antenna assembly disposed along a lateral side of the plurality of sides, the lateral side being substantially perpendicular to the bottom side.

In one variant, the diversity antenna assembly includes: a first diversity antenna apparatus configured to operate in the high frequency range and comprising a first feed portion coupled to the feed structure; and a second diversity antenna apparatus configured to operate in the lower frequency range, and comprising: a first radiator comprising a second feed portion configured to couple a radiating portion to the feed structure; a second radiator, comprising a ground structure coupled to the ground plane; and a selector element configured to selectively couple a selector structure of the second radiator to the ground plane. The selector element is configured to enable wireless communication of the mobile communication device in several (e.g., at least four) operational bands within the lower frequency range.

In another variant, the ground structure is disposed proximate one end of the second diversity antenna apparatus; and the second feed portion is disposed proximate a second end of the second diversity antenna apparatus, the second end disposed opposite from the first end.

In yet another variant, the second feed portion is disposed proximate the first feed portion.

In another variant, the second feed portion and the first feed portion are each coupled to a feed port via a feed cable; and proximity of the second feed portion to the first feed portion is configured to reduce transmission losses in the feed cable. The feed cable comprises for instance a microstrip conductor, or a coaxial cable.

In another variant, the selector structure is disposed in-between the second feed portion and the ground structure.

In still a further variant, the selector element comprises a switching apparatus characterized by a plurality of states and configured to selectively couple the selector structure to the ground plane via at least four distinct circuit paths, and at least one of the distinct circuit paths comprises a reactive circuit.

In a third aspect of the invention, active low band diversity antenna apparatus is disclosed. In one embodiment, the apparatus includes: at least first and second radiating elements; and a coupled feed configuration. The coupled feed configuration enables the diversity antenna apparatus to be substantially insensitive to dielectric loading during device operation; and the antenna apparatus is configured to operate over several spaced bands of a lower frequency range required by a wireless communication network standard.

In one variant, the standard comprises a Long Term Evolution (LTE) standard, and the several spaced bands are selected from the B17, B20, B5, B8, and B13 bands thereof.

In another variant, the apparatus further includes switching apparatus in operative communication with the at least first and second radiating elements and configured to alter the resonant frequency of the antenna apparatus.

In another aspect of the invention, a low frequency range diversity antenna is disclosed which comprises: a coupling element; a first radiating element being adapted for direct coupling to a feed structure of a portable device via the coupling element; and a second radiating element being adapted for connection to a ground plane via at least one ground point. The diversity antenna is fed via the coupling element, and a resonating portion of the low band diversity antenna is formed by grounding a part of the antenna.

In another aspect of the invention, a method of operating a diversity antenna apparatus is disclosed. In one embodiment, the antenna apparatus is for use in a portable radio device, and the method includes selectively switching an element of the antenna apparatus so as to operate the apparatus over several spaced bands of a lower frequency range.

In a fourth aspect of the invention, a method of mitigating the effects of user interference on a radiating and receiving diversity antenna apparatus is disclosed.

In a fifth aspect of the invention, a method of tuning a diversity antenna apparatus is disclosed.

Further features of the present invention, its nature and various advantages will be more apparent from the accompanying drawings and the following detailed description.

BRIEF DESCRIPTION OF THE DRAWINGS

The features, objectives, and advantages of the invention will become more apparent from the detailed description set forth below when taken in conjunction with the drawings, wherein.

Figure 1:
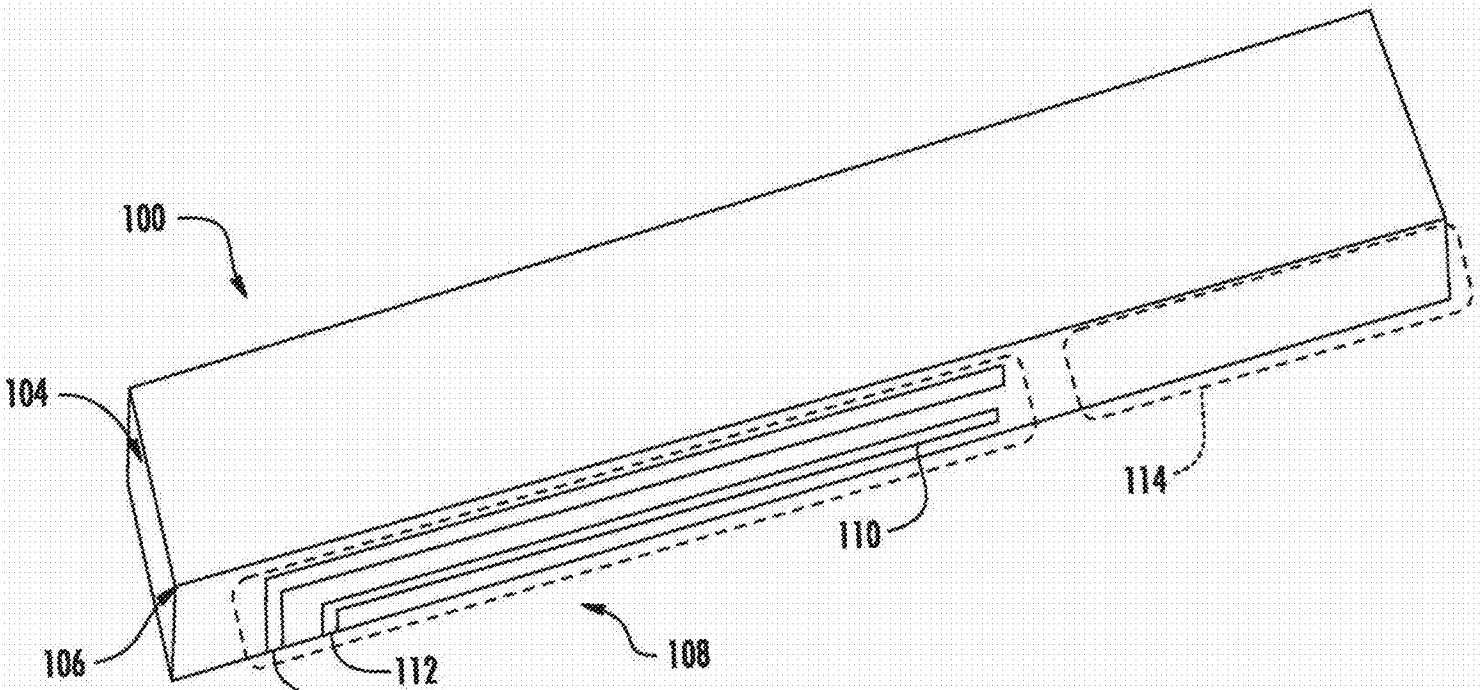
FIG. 1 (PRIOR ART)
FIG. 1 is an isometric view of a mobile device low band passive diversity antenna implementation of the prior art.

All Figures disclosed herein are © Copyright 2011 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," "antenna system," "antenna assembly", and "multi-band antenna" refer without limitation to any apparatus or system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna or portion thereof.

The terms "RF feed," "feed," "feed conductor," and "feed network" refer without limitation to any energy conductor(s) and coupling element(s) that can transfer energy, transform impedance, enhance performance characteristics, and conform impedance properties between an incoming/outgoing RF energy signals to that of one or more connective elements, such as for example a radiator.

As used herein, the terms "loop" and "ring" refer generally and without limitation to a closed (or virtually closed) path, irrespective of any shape or dimensions or symmetry.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), TD-LTE, analog cellular, CDPD, satellite systems such as GPS, millimeter wave or microwave systems, optical, acoustic, and infrared (i.e., IrDA).

Overview

The present invention provides, in one salient aspect, an active low band diversity antenna apparatus for use in a mobile radio device. The antenna apparatus advantageously provides improved radiation efficiency, and enables device operation in several distinct frequency bands of the low frequency range, as compared to prior art solutions. A coupled feed antenna configuration makes the diversity antenna substantially insensitive to dielectric loading during device operation.

In one embodiment, the low frequency range diversity antenna comprises two radiating elements. The first radiating element is directly coupled to the feed structure of the portable device electronics via a coupling element disposed at center of the ground plane edge. The second radiating element is connected to ground at a ground point The diversity antenna is fed via the coupling element, and the resonating part of the low band diversity antenna is formed by grounding a part of the antenna, which produces an antenna envelope correlation coefficient that is similar to an antenna apparatus having the feed point next to main antenna feed point.

The lowest envelope correlation coefficient (ECC) is achieved in the exemplary embodiment when the antenna feed point is disposed along lateral center axis of the ground plane, while the grounding point is located proximate to main antenna at the bottom of the device. ECC increases as the feed point is moved from center of ground plane towards the top of the ground plane.

The distance (gap) between the directly fed radiator and the grounded coupled feed radiator elements is used in one embodiment to adjust antenna Q-value. Resonant frequency tuning is achieved by changing electric length of the grounded element.

Antenna tuning is further achieved by adding a second branch to the grounded radiator element configured to selectively connect (via a switch) the grounded radiator element to a switch contact close to antenna ground point. Different impedances can be used on different output ports of the switch to enable selective tuning of the diversity antenna in different operating bands in the lower frequency range. In one implementation, tuning of the antenna's lowest operating band is achieved when the switch is in an open state (corresponding to high impedance). Respectively, tuning in the highest operating frequency band is enabled when the switch is in a closed position (corresponding to low or ground impedance).

The diversity antenna solution of the invention advantageously enables operation across multiple frequency bands of interest; for example, in all low frequency receive bands (i.e., the bands B17, B20, B5 and B8) currently required by E-UTRA and LTE-compliant networks. Also, operation in B13 is possible by replacing one of the currently presented bands, or by using an SP5T switch (B13 is used in CDMA devices which usually don't require coverage of other LTE bands, which are related to GSM/WCDMA devices).

Compared to a passive design, the antenna feed point of the exemplary embodiments of the invention can be disposed closer to the high band diversity element feed point. This advantageously reduces transmission line loss, and stabilizes diplexer behavior (a diplexer is typically required to combine LB and HB diversity elements into single feed point). The HB element is in one embodiment implemented as a separate element due to better achievable bandwidth within a small antenna volume.

The coupled feed (loop type antenna) arrangement for low band diversity implemented by certain embodiments of the invention is also insensitive to dielectric loading by a user's hand, as compared to monopole type passive diversity antennas which are not.

Methods of operating and tuning the antenna apparatus are also disclosed.

Detailed Description of Exemplary Embodiments

Detailed descriptions of the various embodiments and variants of the apparatus and methods of the invention are now provided. While primarily discussed in the context of mobile devices, the apparatus and methodologies discussed herein are not so limited. In fact, many of the apparatus and methodologies described herein are useful in any number of complex antennas, whether associated with mobile or fixed devices (such as e.g., base stations or femtocells), cellular or otherwise.

Exemplary Antenna Apparatus

Figure 2A:
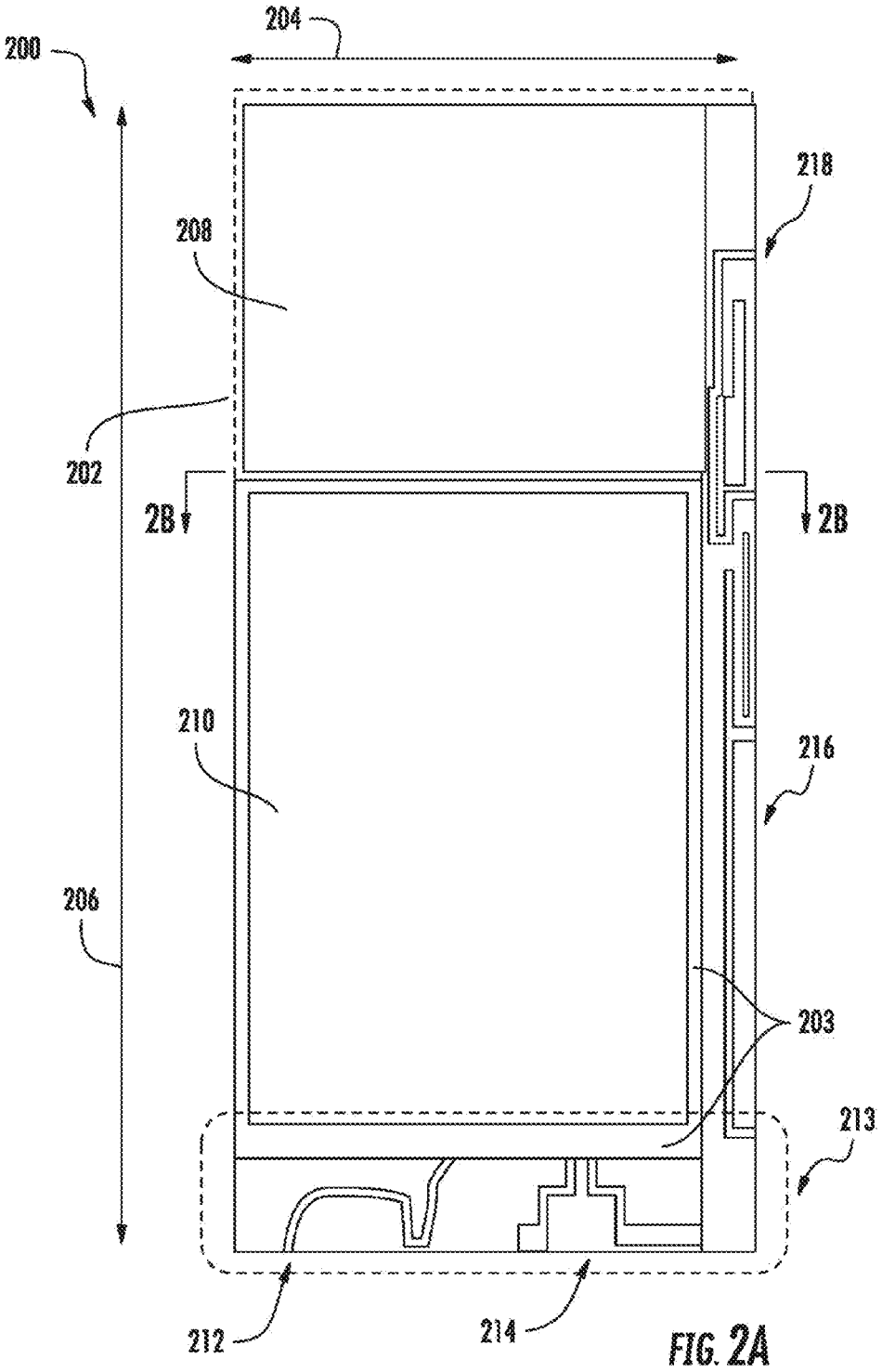
FIG. 2A is a top plan view of a mobile device showing one embodiment of an active low band diversity antenna apparatus according to the invention.
Figure 2B:
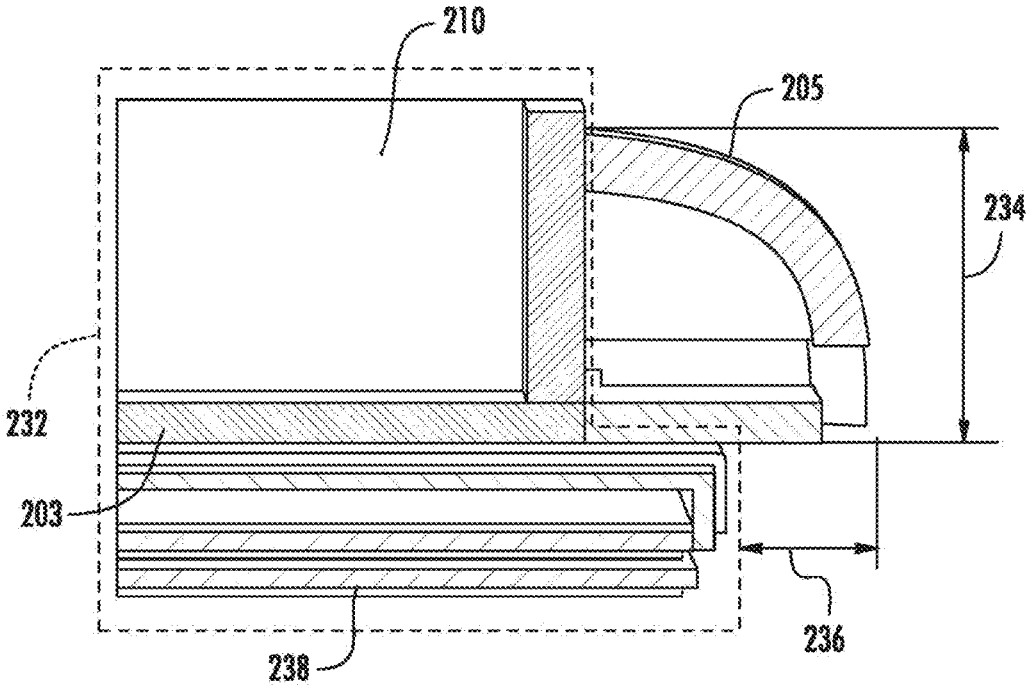
FIG. 2B is a cross-section view of the mobile device embodiment shown in FIG. 2A taken along line 2B-2B, detailing the high frequency band diversity antenna installation.
Figure 2C:
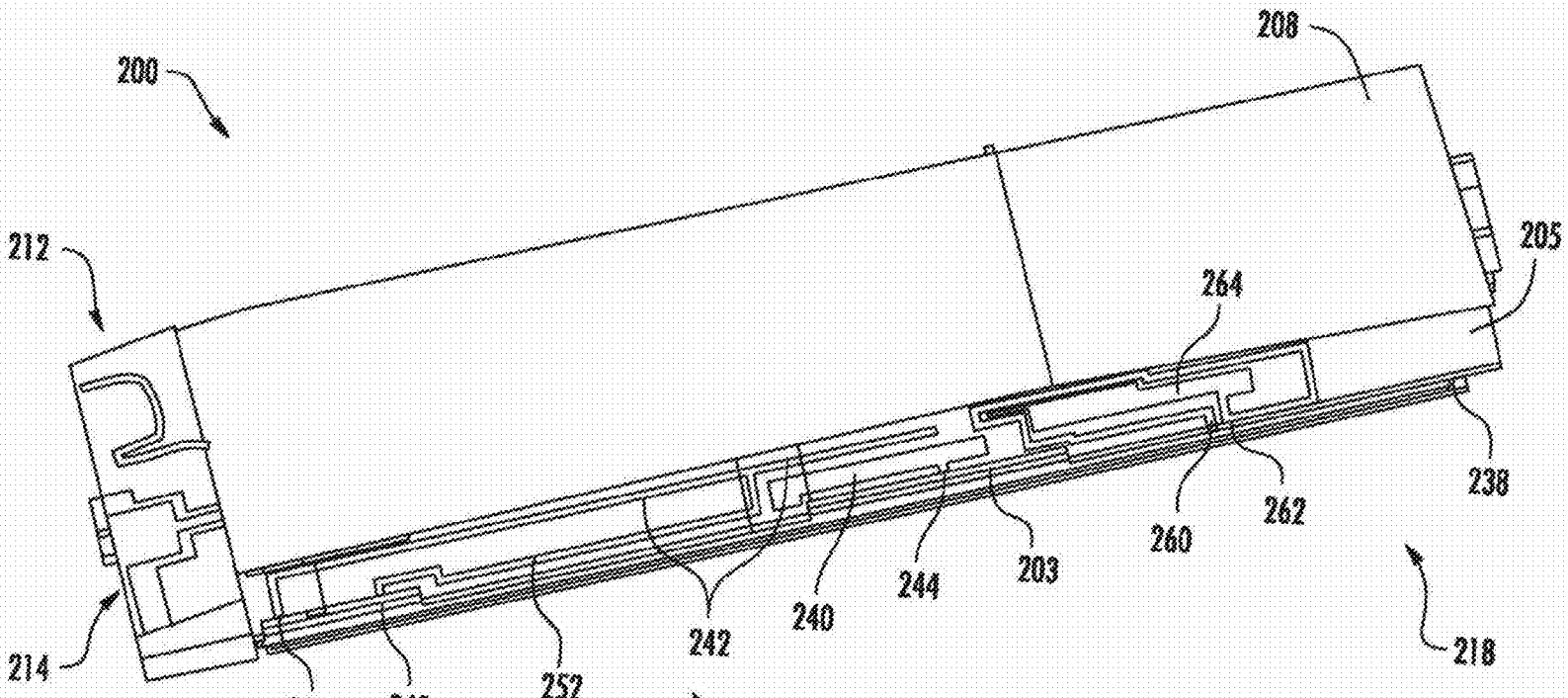
FIG. 2C is an isometric view of the mobile device of FIG. 2A, detailing the active low band antenna apparatus thereof.
Figure 2D:
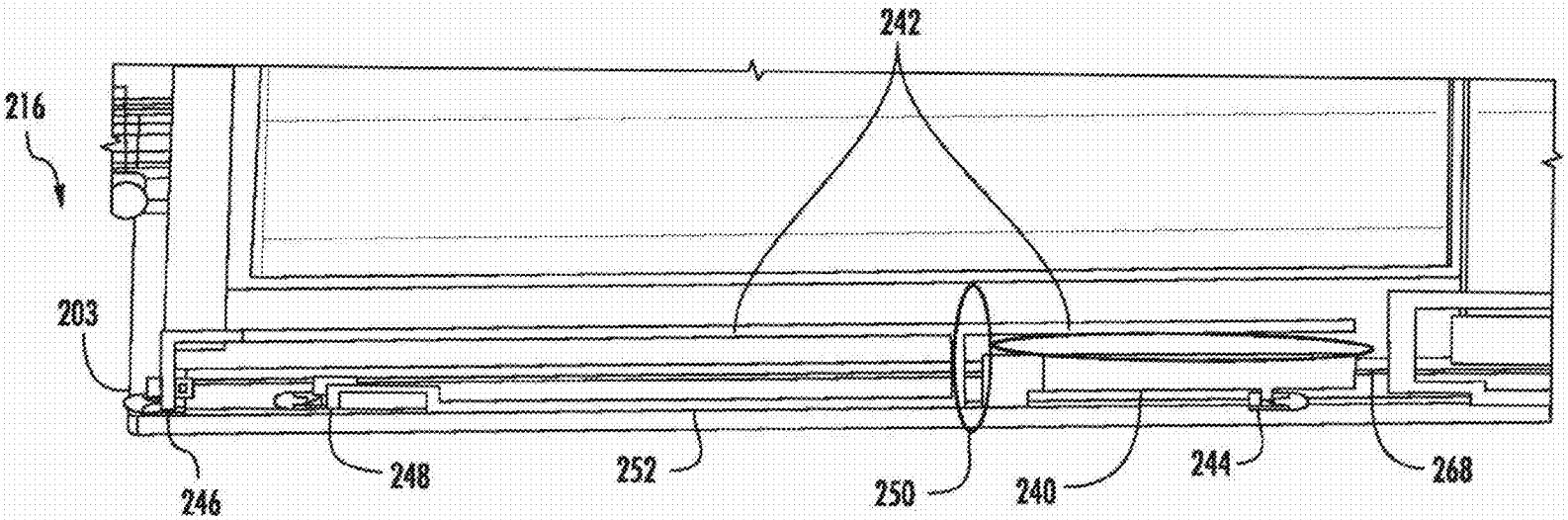
FIG. 2D is a top perspective view of a side portion of the mobile device of FIG. 2A, showing a detail of the structure of the active low band diversity antenna apparatus of FIG. 2C.
Figure 2E:
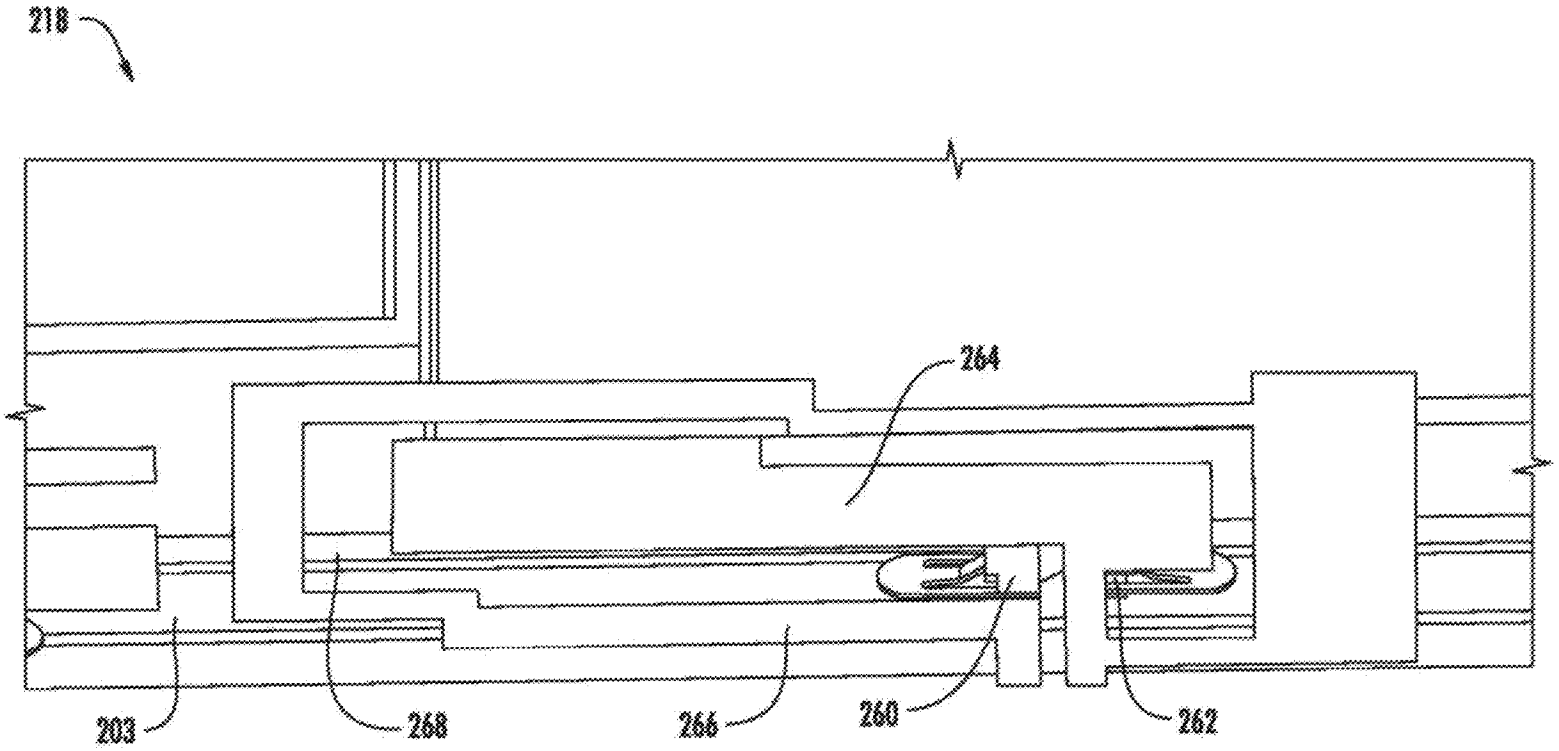
FIG. 2E is a top perspective view of a side portion of the mobile device of FIG. 2A, showing detailed structure of the high band diversity antenna apparatus of FIG. 2C.
Figure 3:
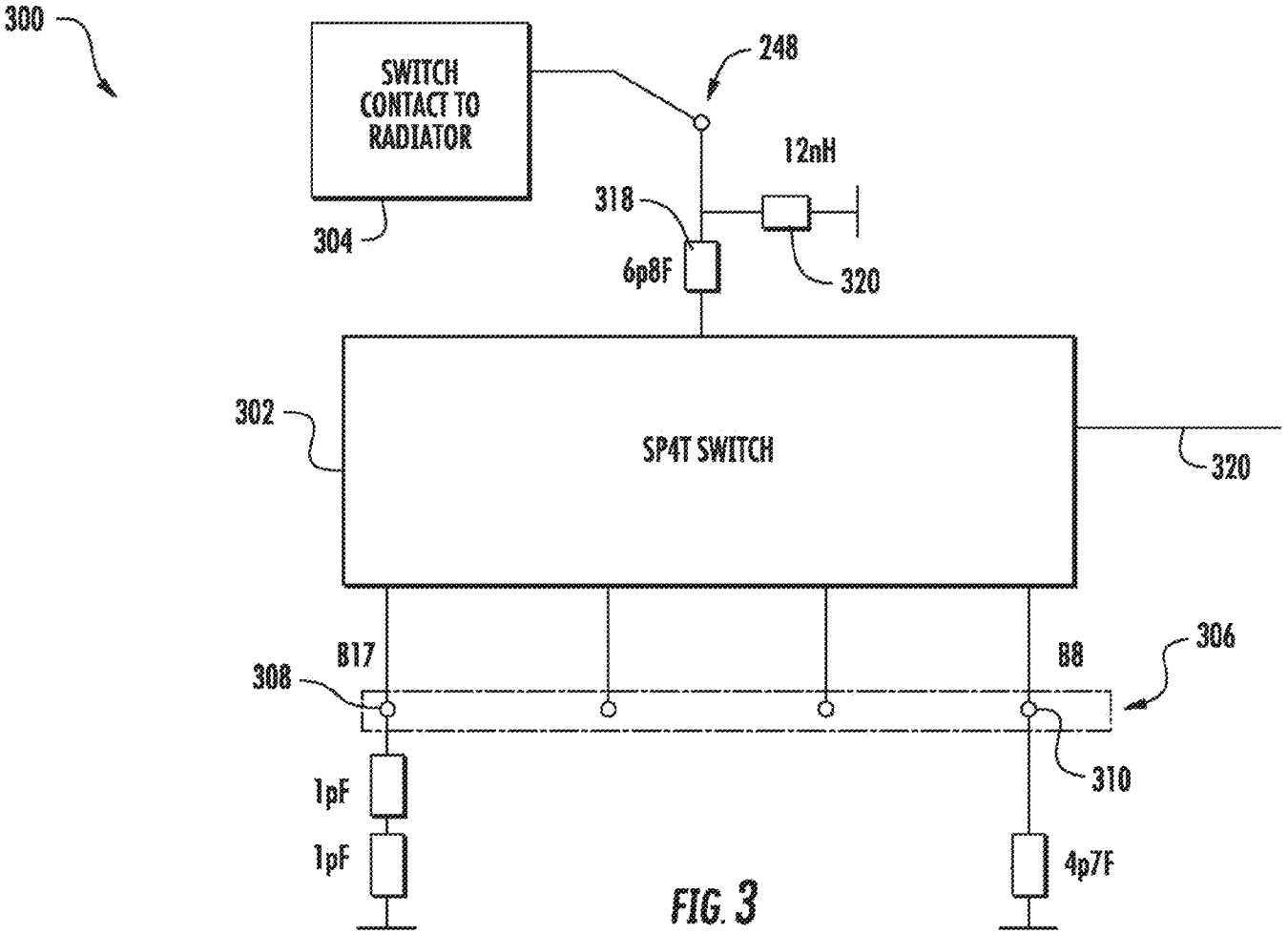
FIG. 3 is a schematic diagram detailing one embodiment of a switching circuit for use with the active antenna apparatus shown in FIG. 2B.

Referring now to FIGS. 2 through 3B, embodiments of the radio antenna apparatus of the invention are described in detail. One exemplary embodiment of the antenna apparatus for use in a mobile radio device is presented in FIG. 2A, showing a top plan view of a mobile communications device 200 with the antenna apparatus installed therein. The device 200 comprises an enclosure 202 (having a longitudinal dimension 206 and a transverse dimension 204) and containing a battery 210 and a transceiver printed wired board (PWB) 208. The device 200 further comprises a ground plane 203. The PWB 208 may, in one implementation, be a part of the device main PWB. The housing 202 may be fabricated from a variety of materials, such as, for example, suitable plastic or metal, and supports a display module. In one variant, the display comprises a touch-screen or other interactive functionality. Notwithstanding, the display may comprise e.g., a display-only device configured only to display information, a touch screen display (e.g., capacitive or other technology) that allows users to provide input into the device via the display, or yet other technology.

The PWB of the device 200 is coupled to the device and the antenna assembly, the latter comprising several antennas: (i) low frequency (LB) main antenna 212; (ii) high frequency (HB) main antenna, 214; (iii) low frequency (LB) diversity antenna 216; and (iv) high frequency diversity antenna 218. In one variant (such as shown in FIG. 2A), the two main antennas 213 are disposed proximate a bottom edge of the device ground plane 203, while the two diversity antennas are disposed along a vertical edge of the ground plane 203. In another variant, the locations of the main and diversity antennas are reversed. It will be appreciated by those skilled in the arts given the present disclosure that other spatial antenna configurations are exemplary and different confirmations may be used, such as, for example, any placement on mobile device ground plane where diversity antenna element has feed point next to main antenna feed point and antennas are aligned substantially perpendicular to each other (e.g. respective ground plane edges) so that the antennas form an angle of or close to 90 degrees between the main and diversity antenna pairs.

By way of background, the main antenna (e.g., the antennas 213 of FIG. 2A) of a portable radio device is typically configured to both transmit and receive RF signals on all operating bands of the device. The diversity antenna (e.g., the antenna 216, 218 of FIG. 2A) is configured to operate only in receive mode, and is required to cover only one receive (RX) frequency band at a time. Typically, the diversity antenna comprises a narrower band of operation as compared to the main antenna. While the main antenna communicates (transmits and receives) data with the base station via one propagation channel, the diversity antenna is receives same signal from the base station via a second propagation channel. When, for example, the first propagation channel is disturbed, the second propagation channel is used to deliver signals to the device. Such configuration provides spatial redundancy, and may also be used to increase data throughput of the overall downlink from bases station to mobile device. In one implementation, the signals propagating on the two propagation channels have different polarizations, thus creating redundancy via polarization diversity.

FIG. 2B shows a portion of the mobile device 200 cross-section 2B-2B illustrating spatial constrains for diversity antenna placement that are imposed by a typical wireless device mechanical construction. In order to reduce the overall device width, it is desirable to implement diversity antenna radiators without increasing the device housing overall dimensions. Diversity antenna placement options are further restricted by the various metal components of the portable device 200, such as for example, the ground plane 203, the display 238, and the battery 210. The dashed line denoted by 232 in FIG. 2B envelops the area of the exemplary device containing metal components, thus illustrating the limited amount of space that is available for the diversity antennas 216, 218. The antenna frame 205 in FIGS. 213-2C (typically fabricated from plastic) is configured to support antenna radiators.

In the implementation illustrated in FIGS. 2A, 2C, the device housing 202 is 125 mm (5 in.) in length and 68 mm (2.7 in.) in width, and the available ground clearance 236 below the diversity antennas is about 2.8 mm (0.1 in.), with the maximum width of the diversity antenna being limited by the dimension 234, which is about 5.7 mm (0.2 in.).

In order to reduce the size occupied by the diversity antennas, the low band and the high band antennas 216, 218 are implemented using separate radiator elements.

Referring now to FIGS. 2C-2E, the structure of the diversity antennas 216, 218 is shown and described in detail. FIG. 2C presents an isometric view of the mobile device 200 with the back cover and a portion of the device enclosure 202 being removed for viewing. The LB diversity antenna 216 is disposed along a vertical side of the device enclosure 202 proximate location of the main antenna 214. The low frequency range diversity antenna 216 comprises two radiating portions 240, 242. The first radiating portion 240 is directly coupled to the diversity antenna feed structure 268 of the portable device electronics via a feed element 244 disposed at center of the ground plane 203 edge. The second radiator element 242 comprises a linear branch connected to the ground plane via the ground structure 246. The diversity antenna 216 is fed via the coupling element 268, and the resonating part of the low band diversity antenna is formed by grounding the radiator portion 242 of the antenna. The diversity antenna configuration illustrated in FIG. 2C produces antenna envelope correlation coefficient (ECC) that is similar to an antenna apparatus having the feed point next to main antenna feed point.

The lowest ECC is achieved when the antenna feed point is disposed along the lateral center axis of the ground plane, while the grounding point is located proximate to the main antenna at the bottom of the device. ECC increases as the feed point is moved from center of ground plane towards the top of the ground plane.

The distance (gap) 250 shown in FIG. 2D between the two radiator portions 252 and 240 can be used to adjust the antenna Q-value. Resonant frequency tuning is achieved by adjusting the length of the grounded element 242.

LB diversity antenna 216 tuning to a particular operating frequency band is further achieved in one embodiment by adding a second branch 252 to the grounded radiator element 242. The branch 252 is selectively coupled to the ground plane 203 via a switch (shown and described in detail with respect to FIG. 3 below) at a ground switch point 248. The electrical length of the grounded radiator element 242, 252, is varied by changing the amount of current that passes through the radiator arm connected to switch circuit. When the switch is open (corresponding to high impedance at the switch port, when looking from the radiator towards the PCB), most of the current to pass through the solid ground connection, which has low impedance. As the current travels a longer distance, the electric length of the grounded element is increased, thereby lowering the antenna resonance frequency.

Conversely, when the switch is closed, the switch contact has low impedance to ground thus causing most of the current to pass through the switch contact, thereby tuning the antenna resonance to its highest frequency.

The coupled feed (loop type antenna) configuration used to implement the low band diversity antenna 216 is insensitive to dielectric loading by a user's hand, as compared to a typical prior art monopole type passive diversity antenna solution, which does suffer from such sensitivity.

The HB diversity antenna 218 of the illustrated embodiment comprises radiating element 264 that is coupled to the diversity feed structure 268 via a feed element 260, and a loop structure 266 coupled to the ground plane via the ground structure 262.

Compared to passive diversity antenna design shown in FIG. 1, the feed element 244 of the active diversity antenna 216 is moved substantially closer to the feed element 260 of the LB diversity antenna. Close proximity of the diversity feeds 244, 260 reduces transmission line loss in the diversity feed structure 268. and stabilizes diplexer behavior (a diplexer is typically required to combine LB and HB diversity elements into single feed point). The diversity feed structure in one variant of the invention comprises a conductive trace disposed on the PWB dielectric. In another variant, the diversity feed structure 268 is implemented via a coaxial cable or other conductor.

Although the diversity antennas 216, 218 share the common feed structure, the use of separate radiators for HB and LB diversity antennas enables the optimization of antenna bandwidth/available space trade-offs, and achieving the widest diversity bandwidth in the smallest antenna volume.

Furthermore, in some embodiments of the invention, the diversity antenna may practically be placed anywhere within the mobile device provided that (i) the feed point of the diversity antenna is proximate to the main antenna feed; and (ii) the two antennas are aligned perpendicular to one other (e.g., respective ground plane edges, where the antennas are placed so as to form an angle on the order of 90°).

Figure 3A:
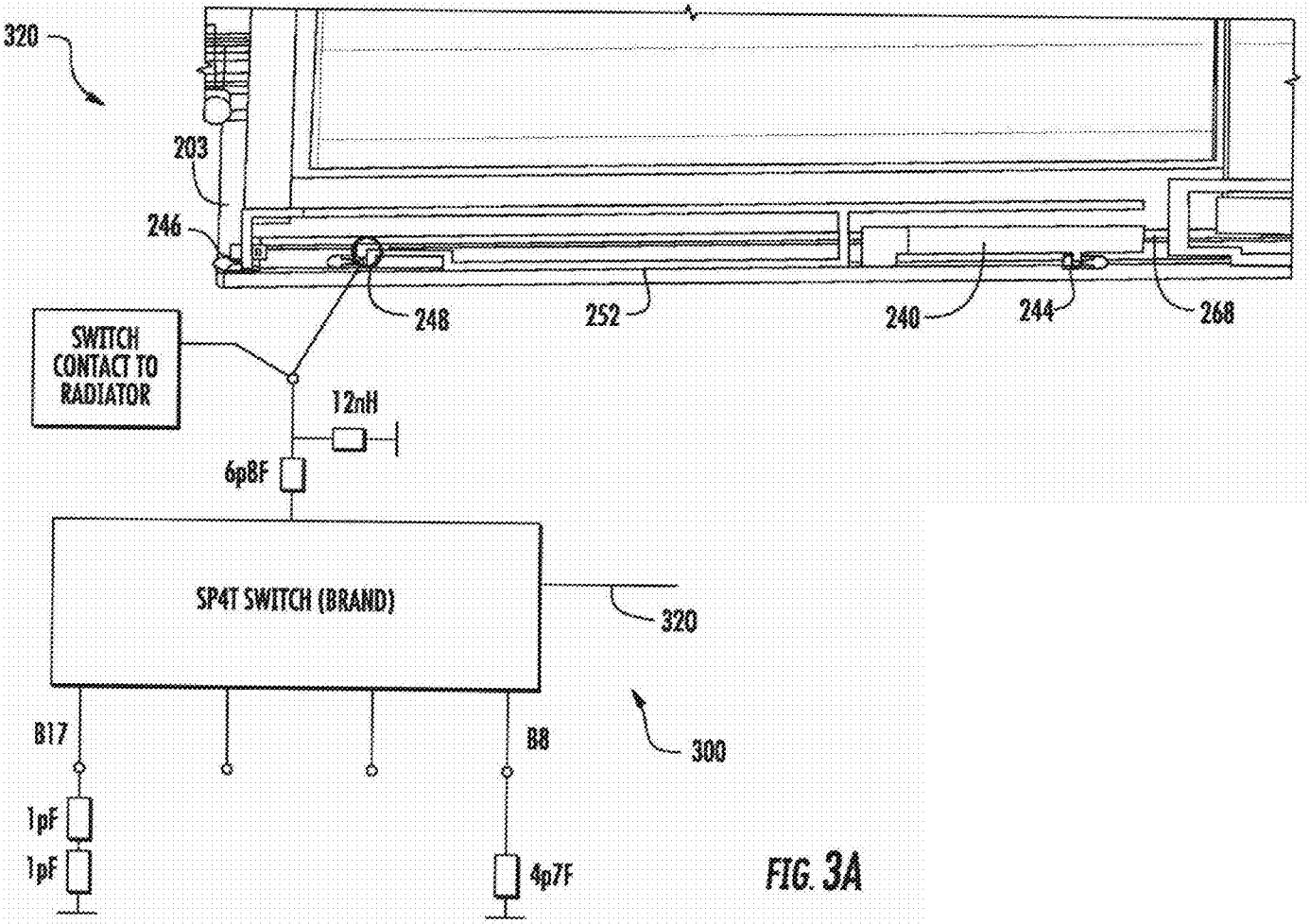
FIG. 3A is a top plan view of the side portion of the mobile device shown in FIG. 2E illustrating the use of the active switching circuit of FIG. 3 according to one embodiment of the invention.

FIGS. 3-3A illustrate one exemplary embodiment of a switching apparatus useful with the low band diversity antenna 216 described supra with respect to FIGS. 2C-2D. The switch apparatus 300 comprises a single pole-four throw switch 302 configured to selectively couple the radiator switch point 304 to the ground plane via any of the four output ports 306. The switch point 248 is coupled to the antenna branch 252 as illustrated in FIG. 3A. A tuning network comprising a capacitor 318 and an inductor 320 is configured to adjust the impedance that is seen by the antenna, thereby enabling antenna tuning to the desired frequency band of operation.

In one implementation, the switch 302 comprises a GaAs SP4T solid-state switch. As is appreciated by those skilled in the arts given this disclosure, other switch technologies and/or a different number of input and output ports may be used according to design requirements. The switch 302 is controlled via a control line 320 coupled to the device logic and control circuitry.

Different impedances can be used on different output ports of the switch 302 (such as the ports 308, 310 in FIG. 3) in order to enable selective tuning of the diversity antenna in different operating bands in the lower frequency range. In one implementation, tuning of the antenna lowest operating band is achieved when the switch is in an open state (corresponding to high impedance). Respectively, tuning in the highest operating frequency band is enabled when the switch is in a closed position (corresponding to low or ground impedance).

The diversity antenna solution of the embodiment of FIG. 3B advantageously enables operation in all low frequency receive bands (e.g., the bands B17, B20, B5 and B8) currently required by LTE-compliant mobile devices. As a brief aside, the frequency band designators used herein in describing antenna embodiments of FIGS. 2A-3B refer to the frequency bands described by the 3rd Generation Mobile System specification "LTE; Evolved Universal Terrestrial Radio Access (E-UTRA); User Equipment (UE) radio transmission and reception, (3GPP TS 36.101 version 9.8.0 Release 9)", incorporated herein by reference in its entirety.

In one variant, the LB diversity antenna of FIG. 3B may be adapted to operate in the B13 low frequency band, frequently employed by CDMA networks, by replacing one of the currently presented bands (i.e., the bands B17, B20, B5 and B8). Although the B13 band is used in CDMA devices which typically do not require coverage of other LTE bands, in another variant, the B13 band may be implemented using a five output SP5T switch in place of the SP4T switch 302, thus enabling mobile device operation in five lower frequency range bands B17, B20, B5, B8, and B13 using a single LB diversity antenna.

Performance

FIGS. 4 through 8B present performance results obtained during simulation and testing by the Assignee hereof of an exemplary antenna apparatus constructed according to one embodiment of the invention.

Figure 4:
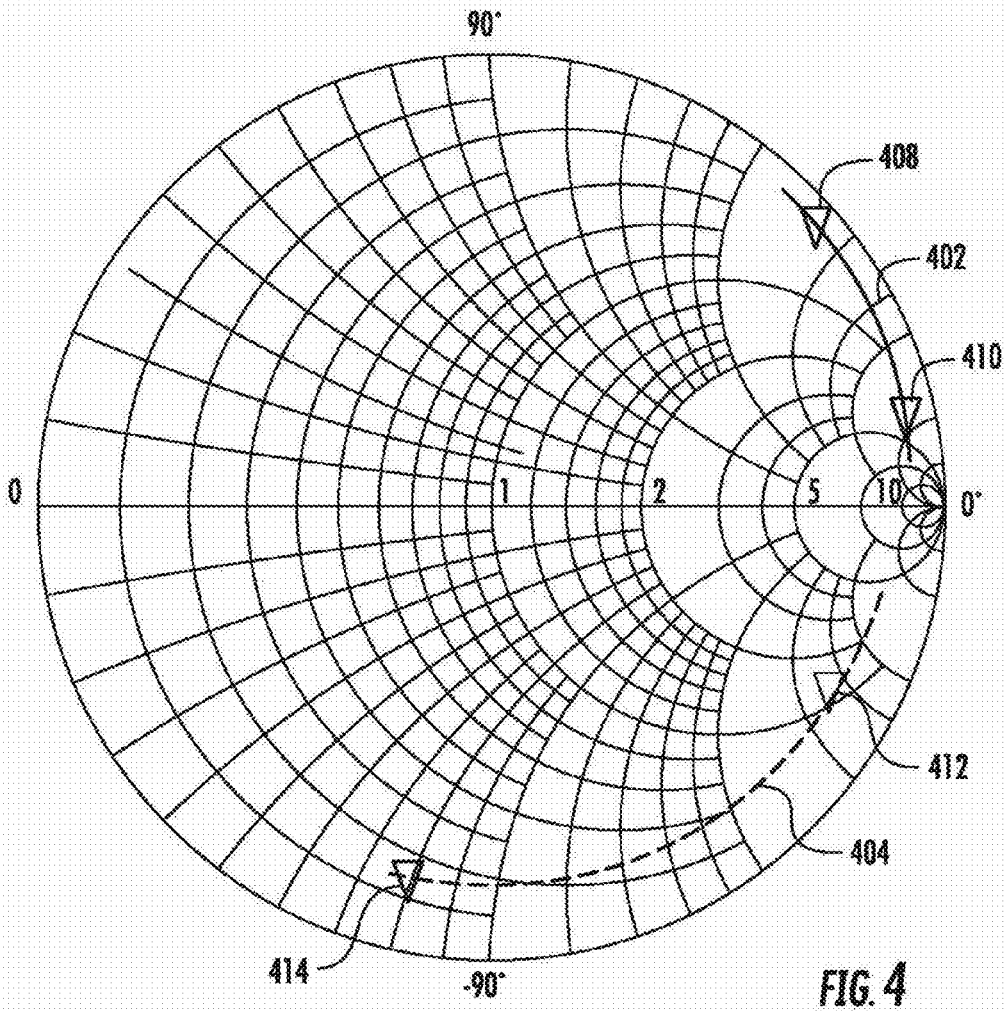
FIG. 4 is a plot of load impedance seen by antenna element measured at the switch pad of the diversity antenna radiator of the exemplary antenna apparatus shown in FIG. 2C.

FIG. 4 shows a polar phase diagram of load impedances measured at the LB diversity antenna switch pad (e.g., the switch pad 248 of FIG. 2D). The curve denoted by the designator 402 corresponds to the measurements taken with the antenna operating in the frequency band 17 (the switch of FIG. 3A in B17 state); the curve denoted by the designator 404 corresponds to the measurements taken with the antenna operating in the frequency band 8 (the switch of FIG. 3A in B8 state).

Table 1 summarizes measurement data corresponding to the triangles marked with the designators 408-414. Data shown in FIG. 4 and Table 1 confirm load impedance phase shift of about 180° deg when the LB diversity antenna operates in the B17 frequency band, as compared to the antenna operating in B8 frequency band. Furthermore, the data in Table 1 show a higher input impedance when the switch is in the B17 position, compared to the B8 position. The lower antenna input impedance in B8 band corresponds to higher currents through the antenna switch contact and causes a frequency shift (tuning) of the antenna operating band towards higher frequencies within the low frequency range of the antenna.

TABLE 1

| State | FIG. 4 designator | Frequency [MHz] | Impedance Magnitude | Impedance Angle [deg] |
|---|---|---|---|---|
| 17 | 408 | 740 | 2.6 | 85.7 |
| 17 | 410 | 942 | 11.5 | 65 |
| 8 | 412 | 740 | 4.1 | −71.6 |
| 8 | 414 | 942 | .8 | −79 |

Figure 5B:
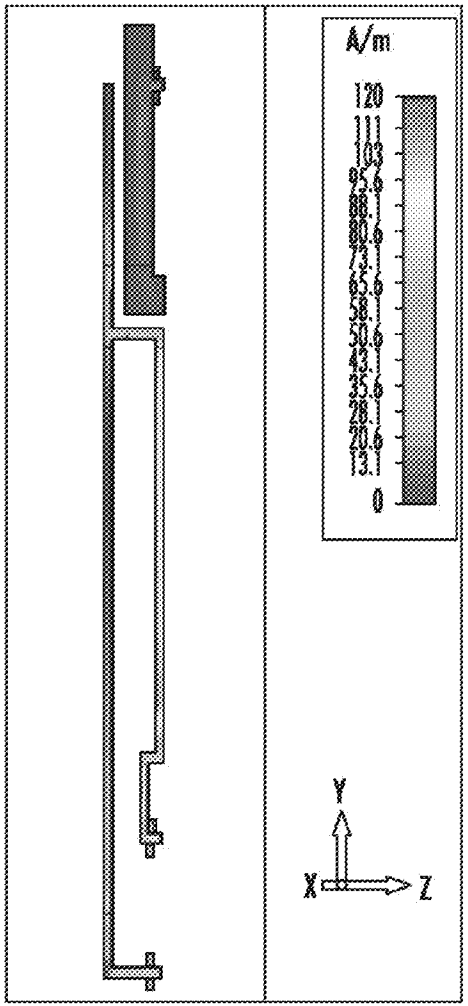
FIG. 5 is a graphical representation of data related to a simulated surface current obtained for the diversity antenna radiator of the exemplary antenna apparatus shown in FIG. 2C.
Figure 5A:
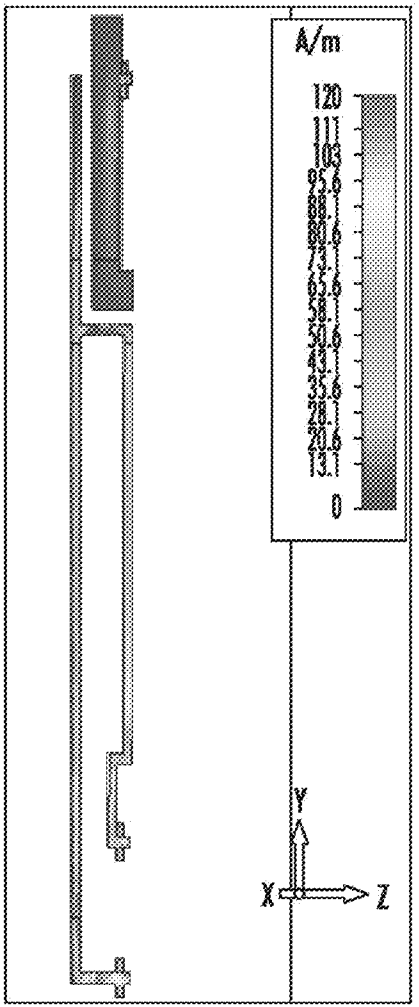

FIGS. 5A-5B present data related to simulated surface currents on diversity antenna radiator 240, 242 of the antenna embodiment of FIG. 3A. The data in FIG. 5A correspond to the switch position of band B17, and show that most of the current flows through the ground contact 246. These data indicate that the electrical length of antenna 216 is determined by the radiator element 242, and comprises the whole longitudinal extent. The data in FIG. 5B are obtained with the antenna switched to operate in the band B8, and show that B17 most of the current flows through the switch contact 248. The data in FIG. 5B indicate that the effective length of the LB diversity radiator is reduced, and is determined by the length of the auxiliary switching branch 252.

Figure 6:
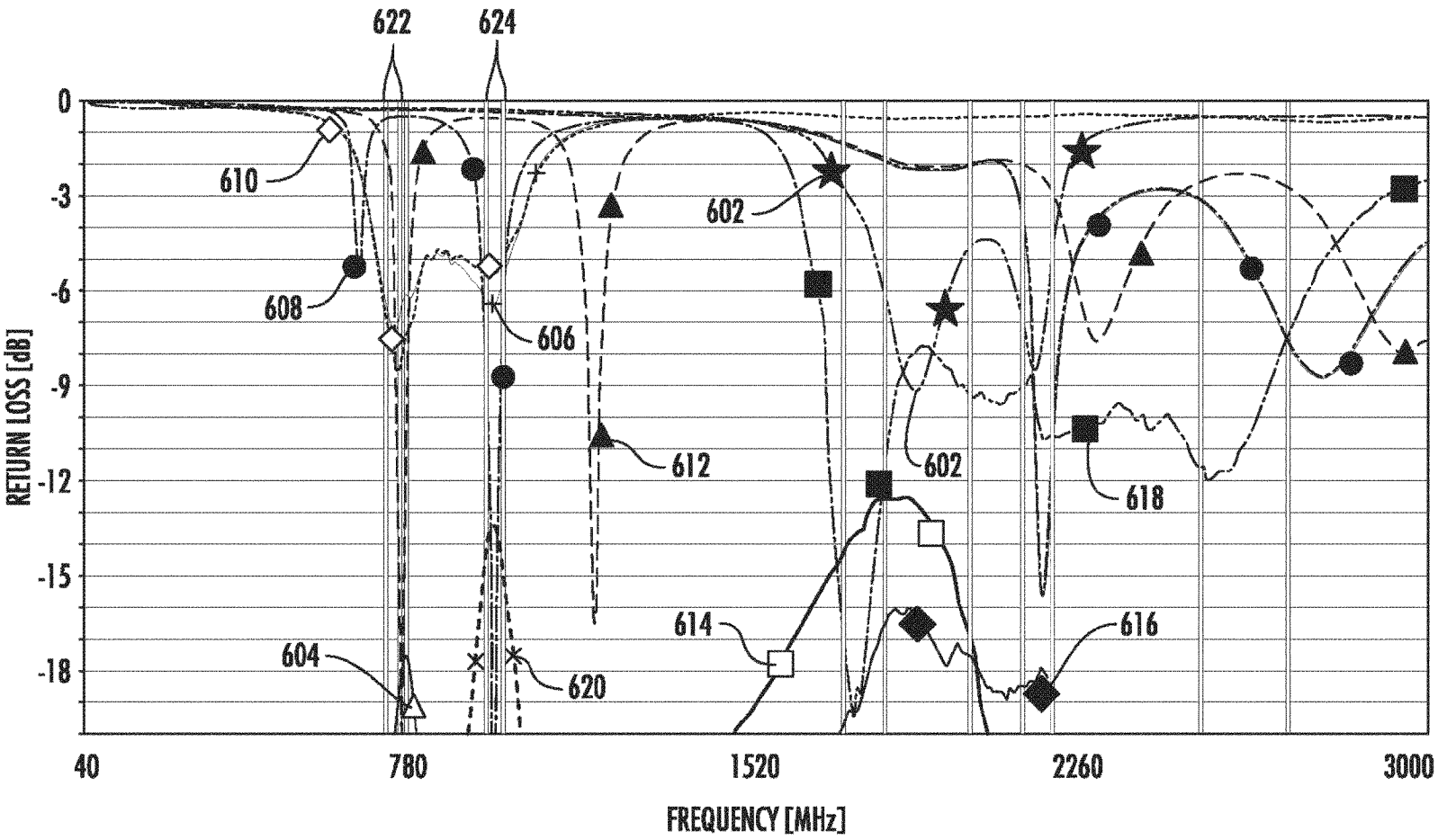
FIG. 6 is a plot presenting data related to free space input return loss measured with an exemplary multiband antenna apparatus configured in accordance with the invention.

FIG. 6 presents data related to return loss in free space (FS) measured with the antenna apparatus comprising the LB main antenna 212, HB main antenna 214, LB diversity antenna 216, and HB diversity antenna 218 constructed according to the exemplary embodiment of FIG. 2A. The solid lines designated with the designators 622, 624 mark the boundaries of frequency bands B17 and B8, respectively. The curves marked with designators 602-620 correspond to measurements obtained in the following antenna configurations:

(i) curve 602—LB diversity antenna 216 in B17 RX state and HB diversity antenna 218;

(ii) curve 604—LB diversity antenna 216 in B17 RX state, and LB main antenna with isolation in free space;

(iii) curve 606—main antenna 212, 214, LB diversity antenna 216 in B17 RX state;

(iv) curve 608—LB diversity antenna 216 in B8 RX state and HB diversity antenna 218;

(v) curve 610—main antenna 212, 214, LB diversity antenna 216 in B17 RX state;

(vi) curve 612—LB diversity antenna 216 in B17 RX state;

(vii) curve 614—LB diversity antenna 216 in B17 RX state, HB diversity antenna 218, FS isolation LB diversity-HB diversity;

(viii) curve 616—LB diversity antenna 216 in B17 RX state, FS isolation HB main-HB diversity;

(ix) curve 618—HB main antenna 214, LB diversity antenna 216 in B17 RX state; and (x) curve 620—LB diversity antenna 216 in B8 RX state, FS isolation LB diversity-LB main.

While the LB diversity antenna of the exemplary antenna apparatus used to obtain measurements shown in FIG. 6 is configured to operate only in the lowest (B17) and the highest (B8) LB RX bands, these bands represent the extreme cases for antenna switching, and it is expected that the bands B20, B5 (that lie in-between B17 and B8) will have at least similar performance as that shown in FIG. 6.

Figure 7A:
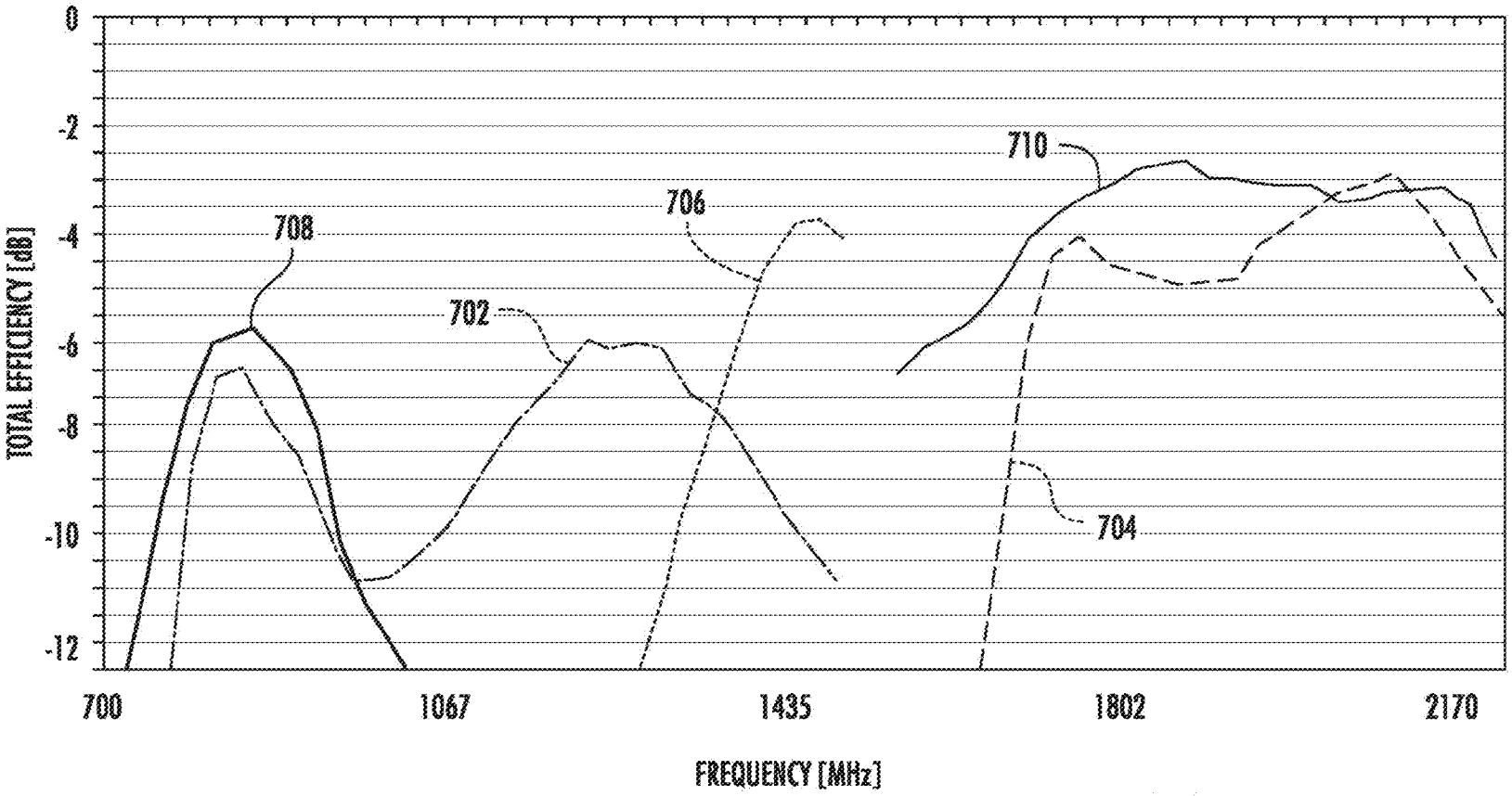
FIG. 7A is a plot presenting data related to total free space efficiency measured with an exemplary low frequency diversity antenna configured in accordance with the invention.

FIG. 7A presents data regarding measured free-space efficiency for the diversity antenna apparatus as described above with respect to FIG. 6 and comprising the LB diversity antenna 216 and the HB diversity antenna 218. Efficiency of an antenna (in dB) is defined as decimal logarithm of a ratio of radiated to input power:

$$AntennaEfficiency = 10\log_{10}\left(\frac{\text{Radiated Power}}{\text{Input Power}}\right) \quad \text{Eqn. (1)}$$

An efficiency of zero (0) dB corresponds to an ideal theoretical radiator, wherein all of the input power is radiated in the form of electromagnetic energy.

The curves marked with designators 702-710 in FIG. 7A correspond to measurements obtained in the following antenna configurations: (i) curves 702, 704 relate to the passive diversity antenna of prior art used as a reference; (ii) curve 706 is taken with the LB diversity antenna 216 in B8 RX state, FS; and (iii) curves 708, 710 are taken with the LB diversity antenna 216 in B17 RX state, FS.

The data in FIG. 7A demonstrate that the active diversity antenna, constructed according with the principles of the present invention, offers an improved performance (as illustrated by higher total efficiency) in both the lower frequency range (curves 706, 708) and the higher frequency range (curve 710) compared to the passive diversity antenna of the prior art.

Figure 7B:
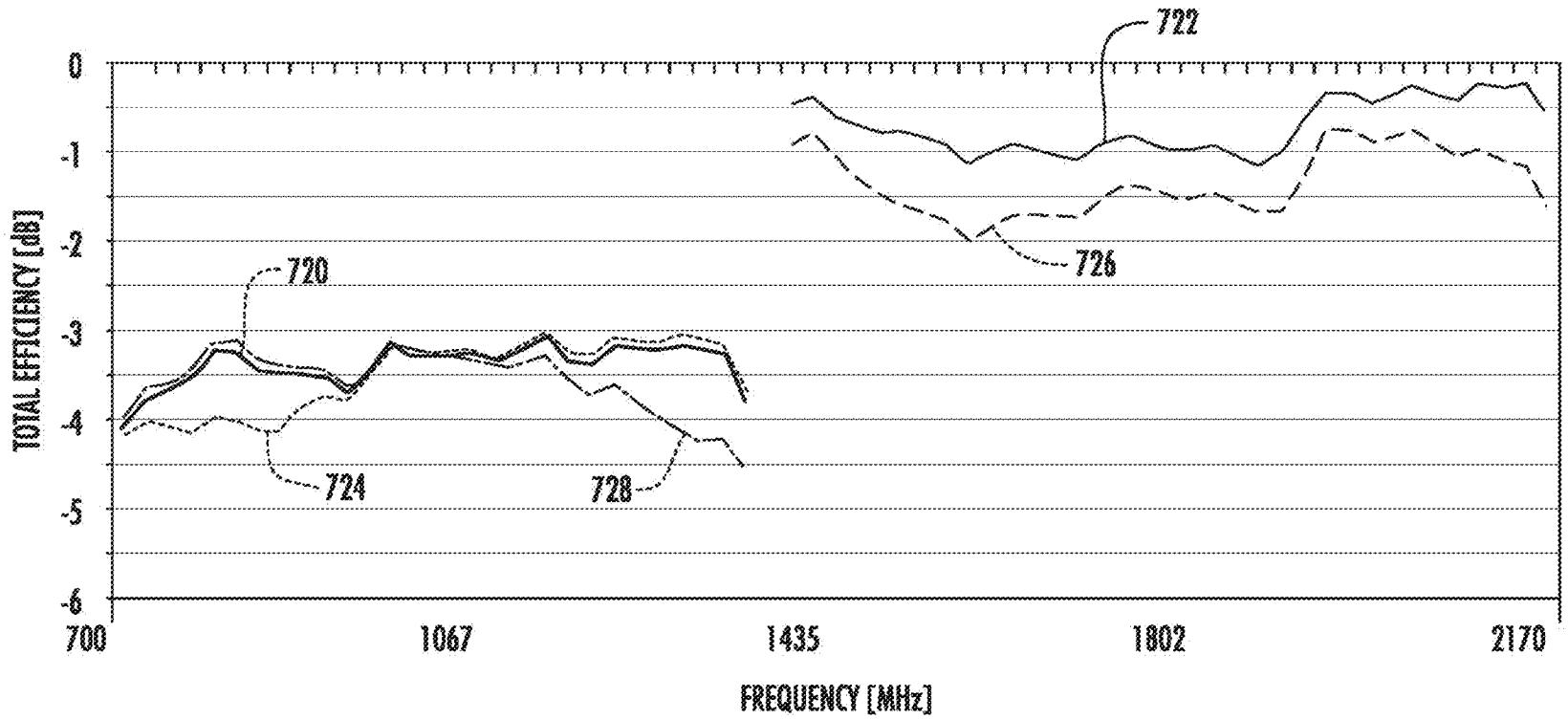
FIG. 7B is a plot presenting data related to total free space efficiency measured with an exemplary low frequency main antenna apparatus configured in accordance with the invention.

FIG. 7B presents data regarding measured free-space efficiency for the antenna apparatus configured as described above with respect to FIG. 6, and comprising four antennas 212, 214, 216, 218. The curves marked with designators 720-728 in FIG. 7B correspond to measurements obtained in the following antenna configurations: (i) curves 720, 722 are taken with the main antenna 212, 214; (ii) curves 724, 726 are taken with the main antenna 212, 214 and the LB diversity antenna in B17 RX state, FS; and (iii) curve 728 is taken with the main antenna 212, 214 and the LB diversity antenna in B8 RX state, FS. The data in FIG. 7B illustrate that the active diversity antenna implementation decreases main antenna efficiency by about 0.5 to 1 dB. HB efficiency change is most likely caused by additional cable added for the HB diversity antenna.

Figure 8A:
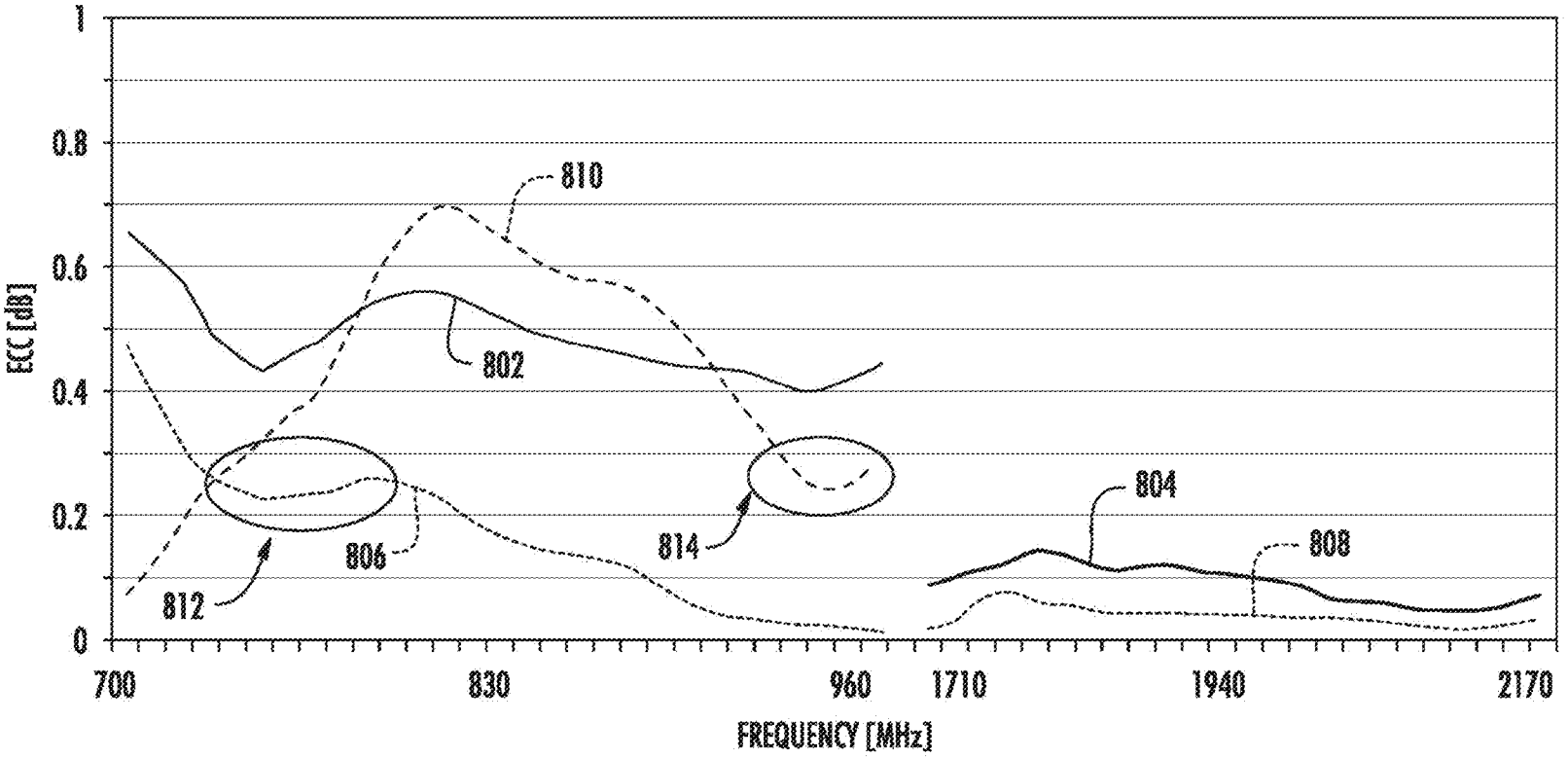
FIG. 8A is a plot presenting data related to free space envelope correlation measured with (i) a passive prior art diversity antenna; (ii) exemplary low band active diversity antenna of the embodiment of FIG. 3A configured to operate in the B17 frequency band; and (iii) exemplary low band active diversity antenna of the embodiment of FIG. 3A configured to operate in the B8 frequency band.

FIG. 8A presents data regarding envelope correlation n(ECC) measured with the antenna apparatus configured as described above with respect to FIG. 6, supra. The curves marked with designators 802-810 in FIG. 8A correspond to measurements obtained with the following configurations: (i) curves 802-804 are taken with the passive diversity antenna of prior art, used as a reference; (ii) curves 806-808 are taken with the LB diversity antenna 216 in B17 RX state and HB diversity antenna 218, FS; and (iii) curve 810 is taken with the LB diversity antenna 216 in B8 RX state, FS. The data in FIG. 8A demonstrate improved diversity antenna operation as indicated by a substantially lower ECC for the diversity antenna of the present invention (curves 806, 808) as compared to prior art (curves 802, 804), as indicated by the areas denoted by the arrows 812, 814 in FIG. 8A.

Test cables that are used during measurements (such as, for example, described with respect to FIG. 8A above) typically adversely affect antenna low band envelope correlation results; hence, model simulation is required to verify ECC behavior as compared to a passive antenna, as described below with respect to FIG. 8B.

Figure 8B:
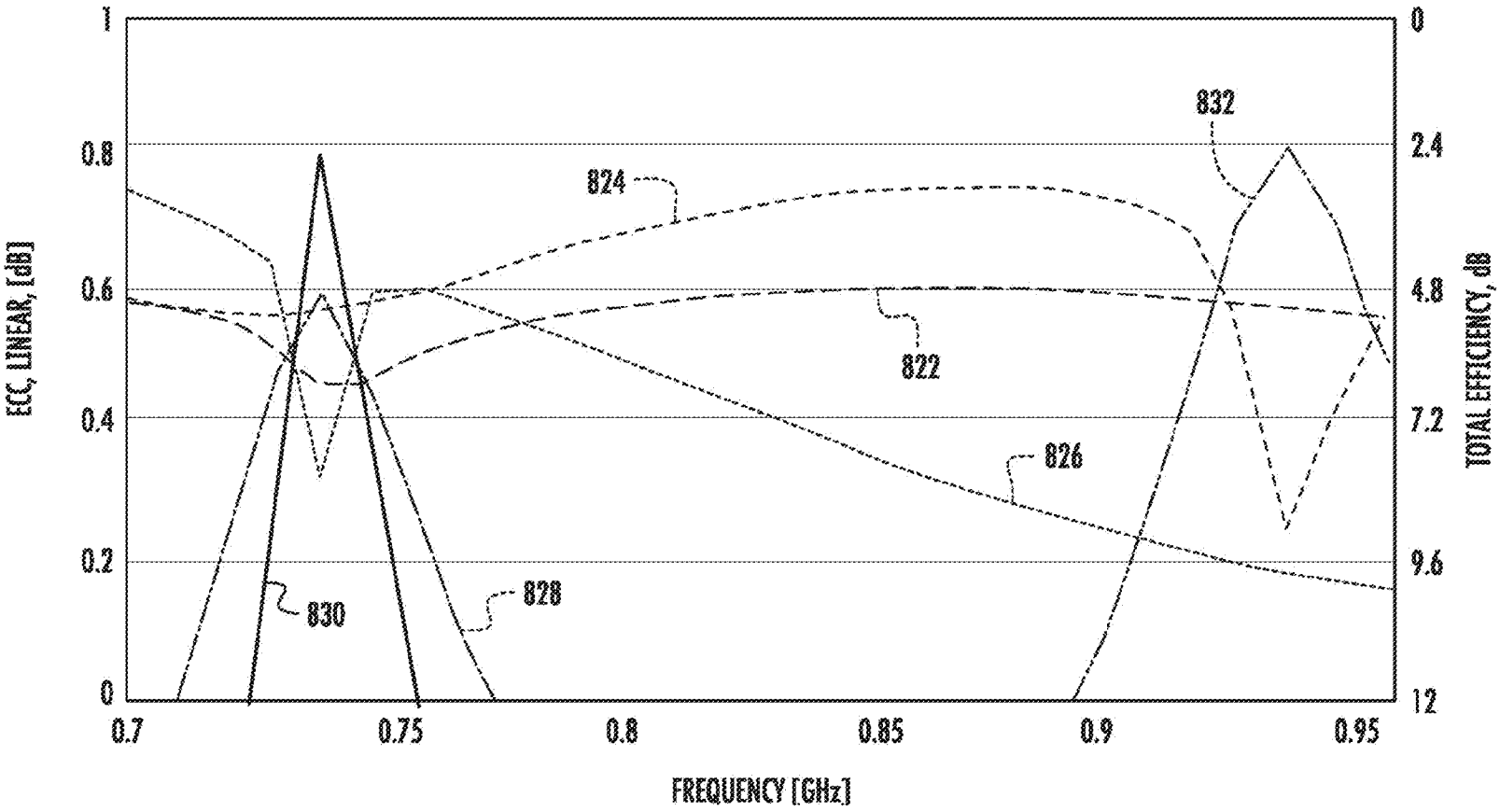
FIG. 8B is a plot presenting simulation data related to free space total input efficiency and envelope correlation obtained for the following antenna apparatus configurations: (i) a passive prior art diversity antenna; (ii) exemplary low band active diversity antenna of the embodiment of FIG. 3A configured to operate in the B17 frequency band; and (iii) exemplary low band active diversity antenna of the embodiment of FIG. 3A configured to operate in the B8 frequency band.

FIG. 8B presents data regarding envelope correlation (ECC) obtained using simulations for the antenna configuration described above with respect to FIG. 6, supra. The curves marked with designators 822-832 in FIG. 8B correspond to data obtained for the following configurations: (i) curve 822 presents ECC data obtained for a passive diversity antenna of prior art and used as a reference for ECC performance comparison; (ii) curve 824 presents ECC data obtained for the LB diversity antenna 216 in B8 RX state; (iii) curve 826 presents ECC data obtained for the LB diversity antenna 216 in B17 RX state, FS; (iv) curve 828 presents total efficiency (TE) data obtained for a passive diversity antenna of prior art and used as a reference for TE performance comparison; (v) curve 830 presents TE data obtained for the LB diversity antenna 216 in B17 RX state; and (vi) curve 832 presents TE data obtained for the LB diversity antenna 216 in B8 RX state, FS.

The data in FIG. 8B demonstrate that the active diversity antenna, constructed according with the principles of the present invention, offers an improved performance (as illustrated by higher total efficiency and a lower ECC) compared to the passive diversity antenna of the prior art.

The data presented in FIGS. 4-8B demonstrate that active low band diversity antenna offers an improved performance over several widely spaced bands (e.g., the bands B17, B8) of the lower frequency range required by modern wireless communication networks. This capability advantageously allows operation of a portable computing or communication device with a single antenna over several mobile frequency bands such as B17, B20, B5, B8, and B13 using a single LB diversity antenna.

While the exemplary embodiments are described herein within the framework of LTE frequency bands, it is appreciated by those skilled in the arts that the principles of the present invention are equally applicable to constructing diversity antennas compatible with frequency configurations of other communications standards and systems, such as WCDMA and LTE-A, TD-LTE, etc.

Advantageously, the switched diversity antenna configuration (as in the illustrated embodiments described herein) further allows for improved device operation by reducing potential for antenna dielectric loading (and associated adverse effects) due to user handling, in addition to the aforementioned breadth and multiplicity of operating bands. Furthermore, the above improvements are accomplished without increasing the volume required by the diversity antennas and size of the mobile device.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. Diversity antenna apparatus, comprising:

a first diversity antenna apparatus configured to operate in a first frequency range and comprising a first feed portion configured to be coupled to a diversity feed structure of a radio device; and a second diversity antenna apparatus configured to operate in a second frequency range, and comprising:

a first radiator comprising a second feed portion configured to couple a radiating portion to the diversity feed structure;

a second radiator comprising a first portion and a second portion, the second portion configured to be coupled to a ground plane of the radio device; and a selector apparatus configured to selectively couple the first portion of the second radiator to the ground plane;

wherein the selector apparatus is configured to enable wireless communication of the radio device in at least two operational bands within the second frequency range; and wherein the first feed portion configured to be coupled to the diversity feed structure forms at least a portion of a coupled-feed configuration, the coupled feed configuration enabling the diversity antenna apparatus to be substantially insensitive to dielectric loading during device operation.

2. The apparatus of claim 1, wherein the at least two operational bands comprise bands specified by a Long Term Evolution (LTE) wireless communications standard.

3. The apparatus of claim 1, wherein the second frequency range is lower in frequency than the first frequency range.

4. The apparatus of claim 1, wherein the first and second frequency ranges do not appreciably overlap in frequency.

5. The apparatus of claim 1, wherein the selector apparatus comprises a switch.

6. The apparatus of claim 5, wherein the switch comprises a single pole, multi-throw switch.

7. A mobile communications device, comprising:

an enclosure comprising a plurality of sides;

an electronics assembly comprising a ground plane and at least one feed structure;

a main antenna assembly configured to operate in a lower frequency range and an upper frequency range and disposed proximate a bottom side of the plurality of sides; and a diversity antenna assembly disposed along a lateral side of the plurality of sides, the lateral side being substantially perpendicular to the bottom side;

wherein the diversity antenna assembly comprises:

a first diversity antenna apparatus configured to operate in the upper frequency range and comprising a first feed portion coupled to the feed structure; and a second diversity antenna apparatus configured to operate in the lower frequency range, and comprising:

a first radiator comprising a second feed portion configured to couple a radiating portion to the feed structure;

a second radiator, comprising a ground structure coupled to the ground plane; and a selector element configured to selectively couple a selector structure of the second radiator to the ground plane; and wherein the selector element is configured to enable wireless communication of the mobile communication device in at least four operational bands within the lower frequency range.

8. The mobile communications device of claim 7, wherein:

the ground structure is disposed proximate a first end of the second diversity antenna apparatus; and the second feed portion is disposed proximate a second end of the second diversity antenna apparatus, the second end disposed opposite from the first end.

9. The mobile communications device of claim 8, wherein the selector structure is disposed in-between the second feed portion and the ground structure.

10. The mobile communications device of claim 8, wherein the second feed portion is disposed proximate the first feed portion.

11. The mobile communications device of claim 8, wherein:

the second feed portion and the first feed portion are each coupled to a feed port via a feed cable; and proximity of the second feed portion to the first feed portion is configured to reduce transmission losses in the feed cable.

12. The mobile communications device of claim 11, wherein, the feed cable comprises a microstrip conductor.

13. The mobile communications device of claim 11, wherein, the feed cable comprises a coaxial cable.

14. The mobile communications device of claim 7, wherein, the selector element comprises a switching apparatus characterized by a plurality of states and configured to selectively couple the selector structure to the ground plane via at least four distinct circuit paths.

15. The mobile communications device of claim 14, wherein at least one of the distinct circuit paths comprises a reactive circuit.

16. The mobile communications device of claim 7, wherein a first distance between the first feed portion and the second feed portion is less than a second distance between the second feed portion and the selector structure.

17. The mobile communications device of claim 7, wherein:

the second diversity antenna is characterized by a longitudinal dimension and a transverse dimension, the longitudinal dimension being greater than the transverse dimension;

the second radiator is configured substantially parallel to the longitudinal dimension;

the main antenna is disposed in an area characterized by a shorter dimension and a longer dimension; and the longitudinal dimension is configured substantially perpendicular to the longer dimension.

18. The mobile communications device of claim 17, wherein:

the area comprises a rectangle;

the transverse dimensions is substantially perpendicular to the longitudinal dimension; and the shorter dimension is substantially perpendicular to the longer dimension.

19. The mobile communications device of claim 7, wherein the second diversity antenna is characterized by a cross-section having a first dimension of no more than 2.8 mm.

20. Active low band diversity antenna apparatus, comprising:

at least first and second radiating elements; and a coupled feed configuration comprising a common feed structure coupled to both: (i) a feed portion of one of the at least first and second radiating elements of the low band diversity antenna apparatus; and (ii) a feed portion of a high band diversity antenna apparatus;

wherein the coupled feed configuration enables the diversity antenna apparatus to be substantially insensitive to dielectric loading during device operation;

wherein the active low band diversity antenna apparatus is configured to operate over several spaced bands of a lower frequency range required by a wireless communication network standard; and wherein the standard comprises a Long Term Evolution (LTE) standard, and the several spaced bands are selected from the B17, B20, B5, B8, and B13 bands thereof.

21. The apparatus of claim 20, further comprising switching apparatus in operative communication with the at least first and second radiating elements and configured to alter resonant frequency of the antenna apparatus.

* * * * *